US010465721B2

(12) United States Patent
Afshari

(10) Patent No.: US 10,465,721 B2
(45) Date of Patent: Nov. 5, 2019

(54) SYSTEM TO PUMP FLUID AND CONTROL THEREOF

(71) Applicant: PROJECT PHOENIX, LLC, Mesa, AZ (US)

(72) Inventor: Thomas Afshari, Phoenix, AZ (US)

(73) Assignee: Project Phoenix, LLC, Mesa, AZ (US)

( * ) Notice: Subject to any disclaimer, the term of this patent is extended or adjusted under 35 U.S.C. 154(b) by 112 days.

(21) Appl. No.: 15/128,269

(22) PCT Filed: Mar. 25, 2015

(86) PCT No.: PCT/US2015/022484

§ 371 (c)(1),
(2) Date: Sep. 22, 2016

(87) PCT Pub. No.: WO2015/148662

PCT Pub. Date: Oct. 1, 2015

(65) Prior Publication Data

US 2017/0097019 A1 Apr. 6, 2017

Related U.S. Application Data

(60) Provisional application No. 61/970,266, filed on Mar. 25, 2014, provisional application No. 61/970,269,
(Continued)

(51) Int. Cl.
*F15B 13/04* (2006.01)
*F15B 13/044* (2006.01)
(Continued)

(52) U.S. Cl.
CPC ..... *F15B 13/044* (2013.01); *F04C 2/18* (2013.01); *F04C 11/008* (2013.01); *F04C 14/08* (2013.01);
(Continued)

(58) Field of Classification Search
CPC ..... F15B 21/14; F15B 15/18; F15B 2211/20561; F15B 2211/20515; F15B 2211/6651
See application file for complete search history.

(56) References Cited

U.S. PATENT DOCUMENTS 337,551 A 3/1886 Berrenberg et al.
688,616 A 12/1901 Ferguson
(Continued)

FOREIGN PATENT DOCUMENTS

CA 2236535 A1 11/1999
CH 625 600 A5 9/1981
(Continued)

OTHER PUBLICATIONS

Esposito, Fluid Power with Applicators, 7th Ed., Chapter 5, pp. 154-162 (2009).
(Continued)

*Primary Examiner* — Thomas E Lazo
(74) *Attorney, Agent, or Firm* — Perkins Coie LLP

(57) ABSTRACT

A pump having a fluid driver disposed within the interior volume of the pump and to a method of delivering fluid from an inlet of the pump to an outlet of the pump using the fluid driver. The fluid driver includes a variable-speed and/or a variable torque prime mover and a fluid displacement assembly. The pump can be used in a fluid pumping system to provide fluid to an actuator that is operated by the fluid. At least one of a speed and a torque of the pump is controlled so as to adjust at least one of a flow and a pressure in the fluid pumping system to a desired set point, without the aid of another flow control device.

15 Claims, 6 Drawing Sheets

Related U.S. Application Data filed on Mar. 25, 2014, provisional application No. 62/006,750, filed on Jun. 2, 2014, provisional application No. 62/006,760, filed on Jun. 2, 2014, provisional application No. 62/017,362, filed on Jun. 26, 2014, provisional application No. 62/017,382, filed on Jun. 26, 2014, provisional application No. 62/054,176, filed on Sep. 23, 2014, provisional application No. 62/060,441, filed on Oct. 6, 2014, provisional application No. 62/066,238, filed on Oct. 20, 2014, provisional application No. 62/066,247, filed on Oct. 20, 2014, provisional application No. 62/066,255, filed on Oct. 20, 2014.

(51) Int. Cl.

| | |
|---|---|
| ***F04C 11/00*** | (2006.01) |
| ***F04C 15/00*** | (2006.01) |
| ***F04C 2/18*** | (2006.01) |
| ***F04C 14/08*** | (2006.01) |
| ***F04C 15/06*** | (2006.01) |
| ***F15B 5/00*** | (2006.01) |
| ***F15B 15/08*** | (2006.01) |

(52) U.S. Cl.

CPC ..... *F04C 15/008* (2013.01); *F04C 15/06* (2013.01); *F15B 5/006* (2013.01); *F15B 15/08* (2013.01); *F04C 2240/30* (2013.01); *F04C 2240/40* (2013.01); *F04C 2270/035* (2013.01); *F04C 2270/051* (2013.01); *F15B 2211/763* (2013.01)

(56) References Cited

U.S. PATENT DOCUMENTS 1,341,846 A 6/1920 Gollings
1,361,423 A 12/1920 Waterous
1,407,496 A 2/1922 Storey
1,418,741 A 6/1922 Stallman
1,665,120 A 4/1928 Wendell
1,681,796 A 8/1928 Wendell
1,712,157 A 5/1929 Morita
2,439,427 A 4/1948 Guibert et al.
2,572,334 A 10/1951 Guibert
2,601,397 A 6/1952 Hill et al.
2,621,603 A 12/1952 Thomas
2,918,209 A 12/1959 Schueller
2,928,295 A 3/1960 Boulanger
2,937,807 A 5/1960 Lorenz
2,940,661 A 6/1960 Lorenz
3,136,224 A 6/1960 Escobosa
3,264,502 A 8/1966 Lytle et al.
3,585,973 A 6/1971 Klover
3,694,105 A 9/1972 Martin
3,763,746 A 10/1973 Walters
3,922,855 A 12/1975 Bridwell et al.
3,979,910 A 9/1976 Leuenberger et al.
4,016,719 A 4/1977 Yavnai
4,030,403 A 6/1977 Elser
4,345,436 A 8/1982 Johnson
4,369,625 A 1/1983 Izumi et al.
4,418,610 A 12/1983 Holtrop
4,529,362 A 7/1985 Ichiryu et al.
4,627,237 A 12/1986 Hutson
4,630,441 A 12/1986 Chamberlain
4,682,939 A 7/1987 Petro
4,850,812 A 7/1989 Voight
5,026,248 A 6/1991 Hamilton
5,197,861 A 3/1993 Maruyama et al.
5,271,719 A 12/1993 Abe et al.
5,295,798 A 3/1994 Maruyama et al.
5,329,216 A 7/1994 Hasegawa
5,708,311 A 1/1998 Claar et al.
5,709,537 A 1/1998 Maruyama et al.
5,767,635 A 6/1998 Steffens et al.
5,767,638 A 6/1998 Wu et al.
5,778,671 A * 7/1998 Bloomquist ..... F15B 21/087 417/371
5,836,746 A 11/1998 Maruyama et al.
6,002,186 A 12/1999 Coutu et al.
6,042,095 A 3/2000 Kuchta
6,048,235 A 4/2000 Kai
6,053,717 A 4/2000 Dixon
6,155,790 A 12/2000 Pyötsiä et al.
6,247,906 B1 6/2001 Pijanowski
6,447,256 B2 9/2002 Bussard
6,447,266 B2 9/2002 Antaki et al.
6,543,223 B2 4/2003 Muschong et al.
6,652,249 B2 11/2003 Kenney et al.
6,796,120 B2 9/2004 Franchet et al.
6,971,463 B2 12/2005 Shore et al.
6,979,185 B2 12/2005 Kaempe
7,051,526 B2 5/2006 Geiger
7,155,910 B2 * 1/2007 Last ..... F15B 7/006 4/502
7,191,593 B1 3/2007 Ho
7,232,292 B2 6/2007 Lopatinsky et al.
7,240,893 B2 6/2007 Komaba et al.
7,434,395 B2 * 10/2008 He ..... F15B 15/18 60/475
7,870,727 B2 1/2011 Mueller et al.
7,927,079 B2 4/2011 Suzuki et al.
8,157,539 B2 4/2012 Hidaka et al.
8,167,589 B2 5/2012 Hidaka et al.
8,448,432 B2 5/2013 Bresie
8,869,924 B2 10/2014 Kim
8,959,905 B2 2/2015 Baltes et al.
2002/0009368 A1 1/2002 Bussard
2003/0077183 A1 4/2003 Franchet et al.
2003/0126981 A1 7/2003 Bridger et al.
2003/0151315 A1 8/2003 Choi et al.
2004/0060430 A1 4/2004 Brinkman
2004/0213680 A1 10/2004 Suzuki et al.
2005/0022523 A1 * 2/2005 Nagai ..... B25B 5/061 60/473
2005/0089414 A1 4/2005 Ohman
2005/0144939 A1 * 7/2005 Mentink ..... B60J 7/1273 60/476
2006/0001202 A1 1/2006 Bauman
2006/0039804 A1 * 2/2006 Jordan ..... B62D 5/064 417/320
2006/0156713 A1 7/2006 Kadlicko
2007/0074511 A1 4/2007 Verkuilen
2007/0098576 A1 * 5/2007 Horng ..... F04C 2/18 417/420
2007/0101711 A1 * 5/2007 Debus ..... B30B 15/166 60/476
2007/0157612 A1 7/2007 He
2007/0166168 A1 7/2007 Vigholm
2008/0010984 A1 1/2008 Arbel et al.
2008/0190104 A1 8/2008 Bresie
2009/0210120 A1 8/2009 Stein et al.
2009/0266934 A1 10/2009 Makino
2010/0247362 A1 9/2010 Koizumi
2010/0264885 A1 10/2010 Olsen et al.
2010/0322805 A1 12/2010 Aregger
2011/0000203 A1 1/2011 Riedel et al.
2011/0017310 A1 1/2011 Eriksson
2011/0030364 A1 2/2011 Persson et al.
2011/0030505 A1 2/2011 Hoyle et al.
2011/0135516 A1 6/2011 Oishi et al.
2011/0250082 A1 10/2011 Han et al.
2012/0173027 A1 7/2012 Cheng et al.
2012/0305603 A1 12/2012 Kwok et al.
2013/0074487 A1 3/2013 Herold et al.
2013/0091833 A1 4/2013 Zhan
2013/0098015 A1 4/2013 Opdenbosh
2013/0098017 A1 4/2013 Knussman et al.
2013/0098464 A1 4/2013 Knussman
2013/0239558 A1 9/2013 Shirao
2013/0298542 A1 11/2013 Lowman et al.

(56) References Cited

U.S. PATENT DOCUMENTS

| | | | |
|---|---|---|---|
| 2014/0105714 | A1 | 4/2014 | Kim |
| 2014/0130487 | A1 | 5/2014 | Akiyama |
| 2014/0174549 | A1 | 6/2014 | Dybing |
| 2014/0308106 | A1 | 10/2014 | Beschorner |
| 2014/0366519 | A1 | 12/2014 | Sadamori |
| 2015/0121860 | A1 | 5/2015 | Hyon |
| 2015/0275927 | A1 | 10/2015 | Gomm et al. |
| 2015/0308463 | A1 | 10/2015 | Gomm et al. |

FOREIGN PATENT DOCUMENTS

| | | | |
|---|---|---|---|
| CN | 101655087 | A | 2/2018 |
| DE | 1 258 617 | | 1/1968 |
| DE | 1 528 965 | | 10/1969 |
| DE | 3 230 550 | A1 | 1/1984 |
| DE | 3 247 004 | A1 | 6/1984 |
| DE | 3 821 321 | A1 | 12/1989 |
| DE | 10 2008 018407 | A1 | 10/2009 |
| DE | 10 2009 027282 | A1 | 12/2010 |
| DE | 10 2009 028095 | A1 | 2/2011 |
| DE | 10 2009 045028 | A1 | 3/2011 |
| DE | 10 2011 005831 | A1 | 9/2012 |
| DE | 10 2012 102156 | A1 | 10/2012 |
| EP | 0 558 921 | A1 | 9/1993 |
| EP | 0 942 173 | A1 | 9/1999 |
| EP | 1 249 608 | A1 | 10/2002 |
| EP | 1 531 269 | | 5/2005 |
| EP | 1 967 745 | A1 | 9/2008 |
| EP | 2 113 666 | A2 | 11/2009 |
| EP | 2 816 237 | A1 | 12/2014 |
| FR | 2.119.294 | | 8/1972 |
| FR | 2 428 771 | | 1/1980 |
| GB | 270 000 | | 5/1927 |
| GB | 1 081 711 | A | 8/1967 |
| GB | 1 284 551 | | 8/1972 |
| GB | 1 284 552 | | 8/1972 |
| GB | 1 284 553 | | 8/1972 |
| GB | 1 450 436 | | 9/1976 |
| GB | 2 123 089 | A | 1/1984 |
| GB | 2 259 333 | | 3/1993 |
| JP | S59-20590 | A | 2/1984 |
| JP | 2001-011899 | A | 1/2001 |
| JP | 2001-153066 | A | 6/2001 |
| JP | 2002-147370 | A | 5/2002 |
| JP | 2003-088084 | A | 3/2003 |
| JP | 2006-316662 | A | 11/2006 |
| JP | 3 154 210 | U | 10/2009 |
| JP | 2014-009655 | A | 1/2014 |
| JP | 2014-512495 | A | 5/2014 |
| RU | 2284424 | C1 | 9/2006 |
| SU | 857550 | | 8/1981 |
| SU | 1 087 705 | A | 4/1984 |
| WO | 91/13256 | A1 | 9/1991 |
| WO | WO 01/073295 | A1 | 10/2001 |
| WO | WO 03/069160 | A1 | 8/2003 |
| WO | WO 2004/071845 | A1 | 8/2004 |
| WO | WO 2008/060681 | A2 | 5/2008 |
| WO | WO 2010/083991 | A2 | 7/2010 |
| WO | WO 2010/097596 | A1 | 9/2010 |
| WO | WO 2011/035971 | A2 | 3/2011 |
| WO | WO 2011/048261 | A1 | 4/2011 |
| WO | WO 2011/072502 | A1 | 6/2011 |
| WO | WO-2011035971 | A3 * | 10/2011 ..... F04C 11/008 |
| WO | 2012/122159 | A2 | 9/2012 |
| WO | WO 2013/06902 | A1 | 1/2013 |
| WO | 2013027620 | A1 | 2/2013 |
| WO | WO 2014/060760 | A2 | 4/2014 |
| WO | WO 2014/135284 | A1 | 9/2014 |

OTHER PUBLICATIONS

International Search Report and Written Opinion, International Applicatoin No. PCT/US2015/018342 (published as WO 2015/131196), 19 pages (dated Jul. 20, 2015).

International Search Report and Written Opinion, International Application No. PCT/US2015/022484, (published as WO 2015/148662), 9 pages (dated Jun. 9, 2015).

International Search Report and Written Opinion, International Application No. PCT/US2015/027003 (published as WO 2015/164453), 18 pages (dated Nov. 4, 2015).

International Search Report and Written Opinion, International Application No. PCT/US2015/033752 (published as WO 2015/187673), 15 pages (dated Sep. 29, 2015).

International Search Report and Written Opinion, International Application No. PCT/US2015/033764 (published as WO 2015/187681), 7 pages (dated Aug. 19, 2015).

International Search Report and Written Opinion, International Application No. PCT/US2015/033776 (published as WO 2015/187688), 31 pages (dated Oct. 28, 2015).

International Search Report and Written Opinion, International Application No. PCT/US2015/041612 (published as WO 2016/014715), 8 pages (dated Sep. 28, 2015).

International Search Report and Written Opinion, International Application No. PCT/US2015/053670 (published as WO 2015/057321), 10 pages (dated Dec. 16, 2015).

International Search Report and Written Opinion, International Application No. PCT/US2015/054145 (published as WO 2016/064569), 9 pages (dated Feb. 2, 2016).

International Search Report and Written Opinion, International Application No. PCT/US2015/050589 (published as WO 2016/048773), 10 pages (dated Dec. 7, 2015).

International Search Report and Written Opinion, International Application No. PCT/US2016/049959 (published as WO 2017/040825), 10 pages (dated Dec. 9, 2016).

International Search Report and Written Opinion, International Application No. PCT/US2016/049918 (published as WO 2017/040792), 10 pages (dated Nov. 23, 2016).

Marks' Standard Handbook for Mechanical Engineers, Eighth Ed., Section 14, pp. 14-1-14-31 (1978).

Supplementary European Search Report, EP Application No. 15802457.0, 24 pages (dated Mar. 14, 2018).

Supplementary European Search Report, EP Application No. 15803186.4, 9 pages (dated Dec. 19, 2017).

Supplementary European Search Report, EP Application No. 15803994.1, 7 pages (dated Jan. 22, 2018).

Yusof et al., "Slip flow coefficient analysis in water hydrauilics gear pump for environmental friendly application," *IOP Conf. Series: Materials Science and Engineering*, 50:012016 (2013).

Supplemental European Search Report, European Application No. EP 18 20 7568.9 (not yet published), 7 pages (dated Feb. 4, 2019).

* cited by examiner

SYSTEM TO PUMP FLUID AND CONTROL THEREOF

PRIORITY

The present application is a 371 of International Patent Application No. PCT/US2015/022484 filed on Mar. 25, 2015, which claims priority to U.S. Provisional Patent Application Nos. 61/970,266 and 61/970,269 filed on Mar. 25, 2014; 62/006,750 and 62/006,760 filed on Jun. 2, 2014; 62/017,362 and 62/017,382 filed on Jun. 26, 2014; 62/054,176 filed on Sep. 23, 2014, 62/060,441 filed on Oct. 6, 2014, and 62/066,238, 62/066,247 and 62/066,255 filed on Oct. 20, 2014, all of which are incorporated herein by reference in their entirety.

TECHNICAL FIELD

The present invention relates generally to various pumps, systems that pump fluid and to control methodologies thereof. More particularly, the present invention relates to a variable-speed, variable-torque pump with a fluid driver that is internal to the pump and control methodologies thereof in a fluid pumping system, including adjusting at least one of a flow and a pressure in the system using the pump and without the aid of another flow control device.

BACKGROUND OF THE INVENTION

Systems in which a fluid is pumped can be found in a variety of applications such as heavy and industrial machines, chemical industry, food industry, medical industry, commercial applications, and residential applications to name just a few. Because the specifics of the pump system can vary depending on the application, for brevity, the background of the invention will be described in terms of a generalized hydraulic system application typically found in heavy and industrial machines. In such machines, hydraulic systems can be used in applications ranging from small to heavy load applications, e.g., excavators, front-end loaders, cranes, and hydrostatic transmissions to name just a few. Depending on the type of system, a conventional machine with a hydraulic system usually includes many parts such as a hydraulic actuator (e.g., a hydraulic cylinder, hydraulic motor, or another type of actuator that performs work on an external load), a hydraulic pump (including a motor and gear assembly), and a fluid reservoir. The motor drives the gear assembly to provide pressurized fluid from the fluid reservoir to the hydraulic actuator, in a predetermined manner. For example, when the hydraulic actuator is a hydraulic cylinder, the hydraulic fluid from the pump causes the piston rod of the cylinder to move within the body of the cylinder. In a case where the hydraulic actuator is a hydraulic motor, the hydraulic fluid from the pump causes the hydraulic motor to, e.g., rotate and drive an attached load. Typically, the hydraulic circuits in such conventional machines are open-loop hydraulic systems in that the pump draws the hydraulic fluid from the fluid reservoir and the hydraulic fluid is sent back to the reservoir after performing work on the hydraulic actuator. That is, the hydraulic fluid output from the hydraulic actuator is not sent directly to the inlet of the pump as in a closed-loop system. In these types of systems, the motor that drives the hydraulic pump is often run at constant speed, typically at a high speed, which builds up temperature in the hydraulic fluid. Thus, the reservoir also acts to keep the average fluid temperature down by increasing the fluid volume in the system. To control the flow in the system, a variable-displacement hydraulic pump and/or a directional flow control valve (or another type of flow control device) can be added to the system. However, these hydraulic systems can be relatively large and complex. In addition, the various components are often located spaced apart from one another. To interconnect these parts, various additional components like connecting shafts, hoses, pipes, and/or fittings are used in a complicated manner. Moreover, these components are susceptible to damage or degradation in harsh working environments, thereby causing increased machine downtime and reduced reliability of the machine.

In addition, conventional external gear pumps, which are typically used in the above-described conventional systems, are configured to have a drive gear and a driven gear in a casing that has an inlet and an outlet (driver-driven configuration). Fluid is transferred from the inlet to the outlet due to the meshing of the two gears. That is, there is an interlock between the drive gear and the driven gear such that, when the drive gear is rotatably driven, the driven gear is rotated by the force produced from the mechanical contact with the drive gear. The drive gear is integral with a shaft that extends outside the casing to connect to an external power source such as an electric motor. The electric motor disposed outside the casing is typically housed in a separate housing. However, these extended shaft and separate housing take up a significant amount of space and increase the weight of the pump. In addition, the pumps may be susceptible to contamination due to components that extend outside the pump casing and/or fluid system. For example, dirt and other contaminates may be able to enter the pump through clearances in the shaft seals or through some other means. Further, the extended shaft may require extra bearing(s) that need proper lubrication, which could increase structural complexity in the gear pump design. Thus, known pumps and systems have undesirable drawbacks with respect to compactness, complexity and reliability of the systems.

Further limitation and disadvantages of conventional, traditional, and proposed approaches will become apparent to one skilled in the art, through comparison of such approaches with embodiments of the present invention as set forth in the remainder of the present disclosure with reference to the drawings.

SUMMARY OF THE INVENTION

Exemplary embodiments of the invention are directed to a pump having a fluid driver and to a method of delivering fluid from an inlet of the pump to an outlet of the pump using the fluid driver. The pump includes a casing defining an interior volume. The casing includes a first port in fluid communication with the interior volume and a second port in fluid communication with the interior volume. The fluid driver is disposed in the interior volume and includes a prime mover and a fluid displacement assembly. That is, unlike conventional pumps, both the prime mover and the fluid displacement assembly are disposed in the interior volume of the pump. Accordingly, pumps consistent with the present invention are less susceptible to contamination because components such as the prime mover and the fluid displacement assembly need not extend outside the pump casing. The prime mover drives the fluid displacement assembly and the prime mover can be, e.g., an electric motor, a hydraulic motor or other fluid-driven motor, an internal-combustion, gas or other type of engine, or other similar device that can drive a fluid displacement member. The prime mover can be variable-speed and/or a variable-torque device. By using a variable-speed and/or a variable-torque device for the prime mover, the flow control valve, variable piston pump, or some other flow control device can be eliminated because the prime mover can control the flow and/or pressure to the desired set point.

The fluid displacement assembly includes at least two fluid displacement members. The fluid displacement members transfer fluid when driven by the prime mover. In exemplary embodiments, the prime mover drives one of the fluid displacement members, which in turn drives at least one other fluid displacement member. The fluid displacement member can work in combination with a fixed element, e.g., pump wall, crescent, or other similar component, and/or a moving element such as, e.g., another fluid displacement member when transferring the fluid. The fluid displacement member can be, e.g., an internal or external gear with gear teeth, a hub (e.g. a disk, cylinder, or other similar component) with projections (e.g. bumps, extensions, bulges, protrusions, other similar structures or combinations thereof), a hub (e.g. a disk, cylinder, or other similar component) with indents (e.g., cavities, depressions, voids or similar structures), a gear body with lobes, or other similar structures that can displace fluid when driven. The configuration of the fluid displacement members in the pump need not be identical. For example, one fluid displacement member can be configured as an external gear-type device and another fluid displacement can be configured as an internal gear-type device. As indicated above, the fluid displacement members are dependently operated, a prime mover drives one fluid displacement member that then dives at least one other fluid displacement member.

In some exemplary embodiments, the fluid displacement assembly includes a first fluid displacing member and a second fluid displacing member. The second fluid displacing member is disposed such that the second fluid displacement member meshes with the first displacement member. The prime mover rotates the first fluid displacement member in a first direction to transfer the fluid from the first port to the second port along a first flow path. The first fluid displacement member then rotates the second fluid displacement member in a second direction to transfer the fluid from the first port to the second port along a second flow path. In some embodiments, the meshing between the two fluid displacement members can be between a surface of at least one projection (bump, extension, bulge, protrusion, another similar structure or combinations thereof) on the first fluid displacement member and a surface of at least one projection (bump, extension, bulge, protrusion, another similar structure or combinations thereof) or an indent (cavity, depression, void or another similar structure) on the second fluid displacement member. In some embodiments, the meshing aids in pumping fluid from the inlet to the outlet of the pump. In some embodiments, the meshing both seals (or substantially seals) a reverse flow path (or backflow path) and aids in pumping the fluid. In some embodiments, the first direction and the second direction are the same. In other embodiments, the first direction is opposite the second direction. In some embodiments, at least a portion of the first flow path and the second flow path are the same. In other embodiments, at least a portion of the first flow path and the second flow path are different.

In some exemplary embodiments, the first fluid displacing member is integrated with the prime mover. For example, the prime mover can be disposed internal to the first fluid displacement member. In other exemplary embodiments, the prime mover is disposed adjacent to the first fluid displacement member but with both inside the pump casing. In some exemplary embodiments, e.g., external gear-type pumps, the fluid displacing members are rotated in opposite directions. In other exemplary embodiments, e.g., internal gear-type pumps, the fluid displacing members are rotated in the same direction.

In another exemplary embodiment, a pump includes a casing defining an interior volume. The casing includes a first port in fluid communication with the interior volume and a second port in fluid communication with the interior volume. A first gear is disposed within the interior volume with the first gear having a plurality of first gear teeth. A second gear is also disposed within the interior volume with the second gear having a plurality of second gear teeth. The second gear is disposed such that a surface of at least one tooth of the plurality of second gear teeth meshes with a surface of at least one tooth of the plurality of first gear teeth. An electric motor, which is disposed in the interior volume, rotates the first gear about a first axial centerline of the first gear. The first gear is rotated in a first direction to transfer the fluid from the first port to the second port along a first flow path. The first gear rotates the second gear about a second axial centerline of the second gear in a second direction to transfer the fluid from the first port to the second port along a second flow path. In some embodiments, the second direction is opposite the first direction and the meshing seals a reverse flow path between the inlet and outlet of the pump. In some embodiments, the second direction is the same as the first direction and the meshing at least one of seals a reverse flow path between the inlet and outlet of the pump and aids in pumping the fluid.

In some exemplary embodiments, the first fluid gear is integrated with the electric motor. For example, the motor can be an external-rotor motor and disposed internal to the first gear. In other exemplary embodiments, the motor is disposed adjacent to the first gear but with both inside the pump casing. In some exemplary embodiments, e.g., external gear pumps, the fluid displacing members are rotated in opposite directions. In other exemplary embodiments, e.g., internal gear pumps, the fluid displacing members are rotated in the same direction.

In other exemplary embodiments, the present invention is directed to a fluid system and method that provides for a more efficient and more precise control of the fluid flow and/or pressure in the system by using a variable-speed and/or a variable-torque pump. The fluid pumping system and method of control thereof discussed below are particularly advantageous in a closed-loop type system since the more efficient and more precise control of the fluid flow and/or the pressure in such systems can mean the elimination of fluid reservoirs and/or smaller accumulator sizes without increasing the risk of pump cavitation or high fluid temperatures as in conventional systems. In an exemplary embodiment, a hydraulic system includes a hydraulic actuator that controls a load. The hydraulic system also includes a hydraulic pump to provide hydraulic fluid to the hydraulic actuator to operate the hydraulic actuator. The hydraulic system further includes a means for adjusting at least one of a flow and a pressure in the hydraulic system to a desired set point. The adjustment means exclusively uses the hydraulic pump to adjust the flow and/or the pressure in the hydraulic system, i.e., without the aid of another flow control device, to control the flow and/or pressure in the system to the desired set point.

In another exemplary embodiment, a fluid system includes a variable-speed and/or a variable-torque pump, an actuator that is operated by the fluid to control a load, and a controller to control a speed and/or torque of the pump. The pump provides fluid to the actuator, which can be, e.g., a fluid-actuated cylinder, a fluid-driven motor or another type of fluid-driven actuator that controls a load (e.g., a boom of an excavator, a hydrostatic transmission, or some other equipment or device that can be operated by an actuator). The pump includes a prime mover and a fluid displacement assembly. The pump is consistent with the exemplary embodiments of the pump discussed above and further below. The fluid displacement assembly can be driven by the prime mover such that fluid is transferred from the inlet port to the outlet port of the pump. The controller controls a speed and/or a torque of the prime mover so as to exclusively adjust a flow and/or a pressure in the fluid system. "Exclusively adjust" means that the flow and/or the pressure in the system is adjusted by the prime mover and without the aid of another flow control device, e.g., flow control valves, variable flow piston pumps, and directional flows valves to name just a few. That is, unlike a conventional fluid system, the pump is not run at a constant speed and/or use a separate flow control device (e.g., directional flow control valve) to control the flow and/or pressure in the system.

The summary of the invention is provided as a general introduction to some embodiments of the invention, and is not intended to be limiting to any particular configuration or system. It is to be understood that various features and configurations of features described in the Summary can be combined in any suitable way to form any number of embodiments of the invention. Some additional example embodiments including variations and alternative configurations are provided herein.

BRIEF DESCRIPTION OF THE DRAWINGS

The accompanying drawings, which are incorporated herein and constitute part of this specification, illustrate exemplary embodiments of the invention, and, together with the general description given above and the detailed description given below, serve to explain the features of the invention.

DETAILED DESCRIPTION OF THE PREFERRED EMBODIMENTS

Exemplary embodiments of the present invention are directed to a pump where the fluid driver, which includes a prime mover and a fluid displacement assembly, is located entirely within the pump casing. In some embodiments, the prime mover is integrated with the fluid displacement assembly, e.g., the prime mover can be disposed internal to or within a component of the fluid displacement assembly. In other embodiments, the prime mover is located adjacent to the fluid displacement assembly but still within the pump casing. In some embodiments, the prime mover can be a variable-speed and/or a variable torque prime mover. Exemplary embodiments of the present invention are also directed to a system and method that provides for a more efficient and more precise control of the fluid flow and/or pressure in the system by using the variable-speed and/or variable-torque inventive pump. In some embodiments, the inventive pump is used to exclusively adjust the flow and/or pressure in the system.

For clarity and brevity, the exemplary embodiments will be described using embodiments in which the pump is an external gear pump with one prime mover, the prime mover is an electric motor, and the fluid displacement assembly is configured as external spur gears with gear teeth. However, those skilled in the art will readily recognize that the concepts, functions, and features described below with respect to a motor-driven, external-spur gear pump can be readily adapted to external gear pumps with other gear designs (helical gears, herringbone gears, or other gear teeth designs that can be adapted to drive fluid), internal gear pumps with various gear designs, to pumps with more than two fluid displacement members, to prime movers other than electric motors, e.g., hydraulic motors or other fluid-driven motors, internal-combustion, gas or other type of engines or other similar devices that can drive a fluid displacement member, and to fluid displacement members other than an spur external gear with gear teeth, e.g., internal gear with gear teeth, a hub (e.g. a disk, cylinder, or other similar component) with projections (e.g. bumps, extensions, bulges, protrusions, other similar structures, or combinations thereof), a hub (e.g. a disk, cylinder, or other similar component) with indents (e.g., cavities, depressions, voids or similar structures), a gear body with lobes, or other similar structures that can displace fluid when driven.

Figure 1:
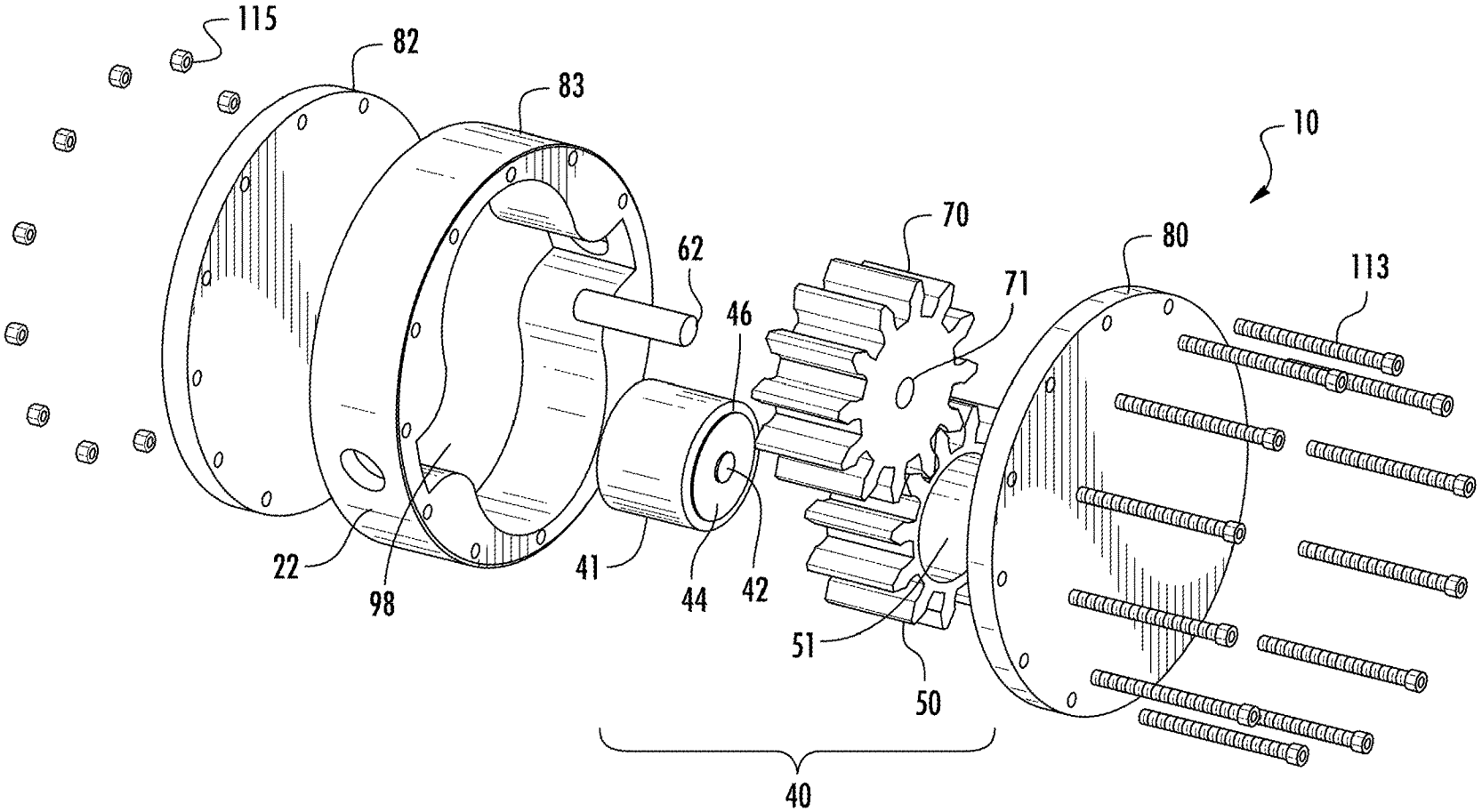
FIG. 1 shows an exploded view of an exemplary embodiment of an external gear pump.

FIG. 1 shows an exploded view of an embodiment of a pump 10 that is consistent with the present disclosure. The pump 10 includes a fluid driver 40 that includes motor 41 (prime mover) and a gear displacement assembly that includes gears 50, 70 (fluid displacement members). In this embodiment, pump motor 41 is disposed inside the pump gear 50. As seen in FIG. 1, the pump 10 represents a positive-displacement (or fixed displacement) gear pump. The pump 10 has a casing 20 that includes end plates 80, 82 and a pump body 83. These two plates 80, 82 and the pump body 83 can be connected by a plurality of through bolts 113 and nuts 115 and the inner surface 26 defines an inner volume 98. To prevent leakage, O-rings or other similar devices can be disposed between the end plates 80, 82 and the pump body 83. The casing 20 has a port 22 and a port 24 (see also FIG. 2), which are in fluid communication with the inner volume 98. During operation and based on the direction of flow, one of the ports 22, 24 is the pump inlet port and the other is the pump outlet port. In an exemplary embodiment, the ports 22, 24 of the casing 20 are round through-holes on opposing side walls of the casing 20. However, the shape is not limiting and the through-holes can have other shapes. In addition, one or both of the ports 22, 24 can be located on either the top or bottom of the casing. Of course, the ports 22, 24 must be located such that one port is on the inlet side of the pump and one port is on the outlet side of the pump.

As seen in FIG. 1, a pair of gears 50, 70 are disposed in the internal volume 98. Each of the gears 50, 70 has a plurality of gear teeth 52, 72 extending radially outward from the respective gear bodies. The gear teeth 52, 72, when rotated by, e.g., motor 41, transfer fluid from the inlet to the outlet, i.e., motor 41 rotates gear 50 which then rotates gear 70 (driver-driven configuration). In some embodiments, the pump 10 is bi-directional. Thus, either port 22, 24 can be the inlet port, depending on the direction of rotation of gears 50, 70, and the other port will be the outlet port. The gear 50 has a cylindrical opening 51 along an axial centerline of the gear body. The cylindrical opening 51 can extend either partially through or the entire length of the gear body. The cylindrical opening 51 is sized to accept the motor 41, which includes a shaft 42, a stator 44, and a rotor 46.

Figure 2:
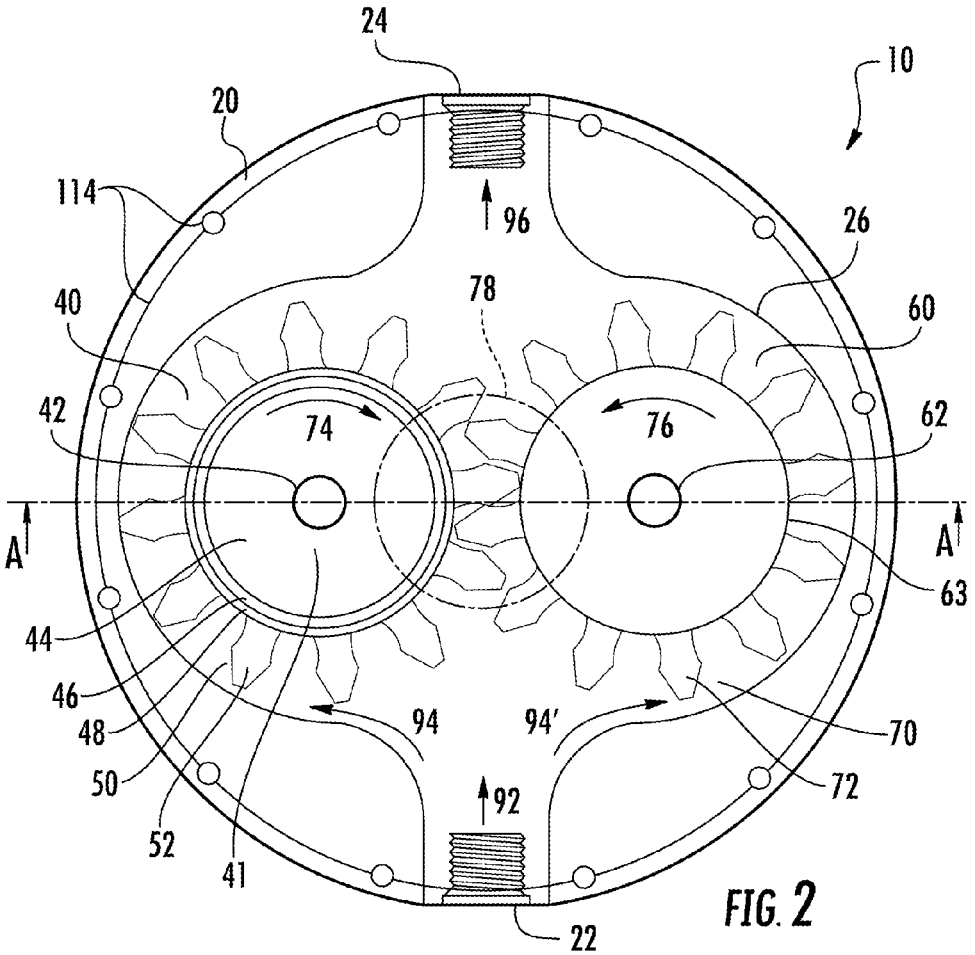
FIG. 2 shows a top cross-sectional view of the gear pump of FIG. 1.
Figure 2A:
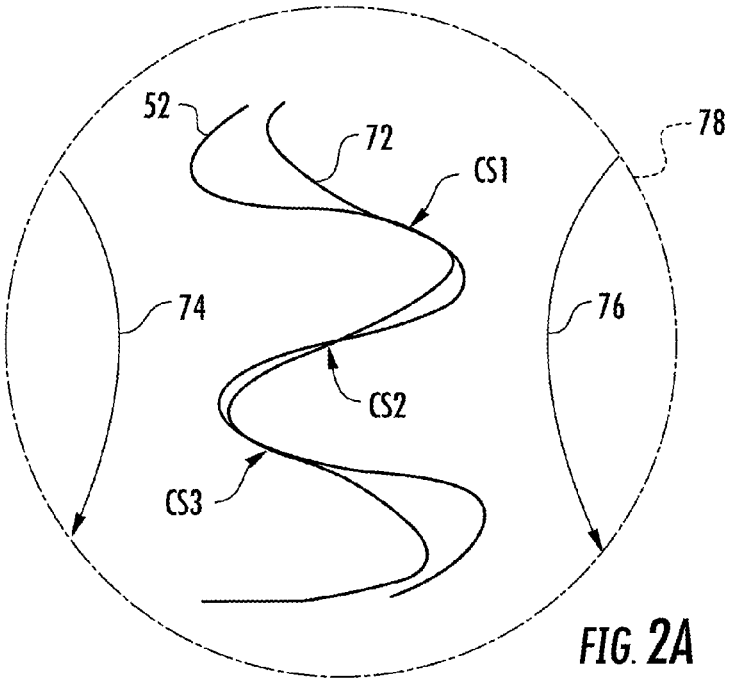
FIG. 2A shows a cross-sectional view illustrating a meshing area between two gears in the external gear pump of FIG. 1.
Figure 2B:
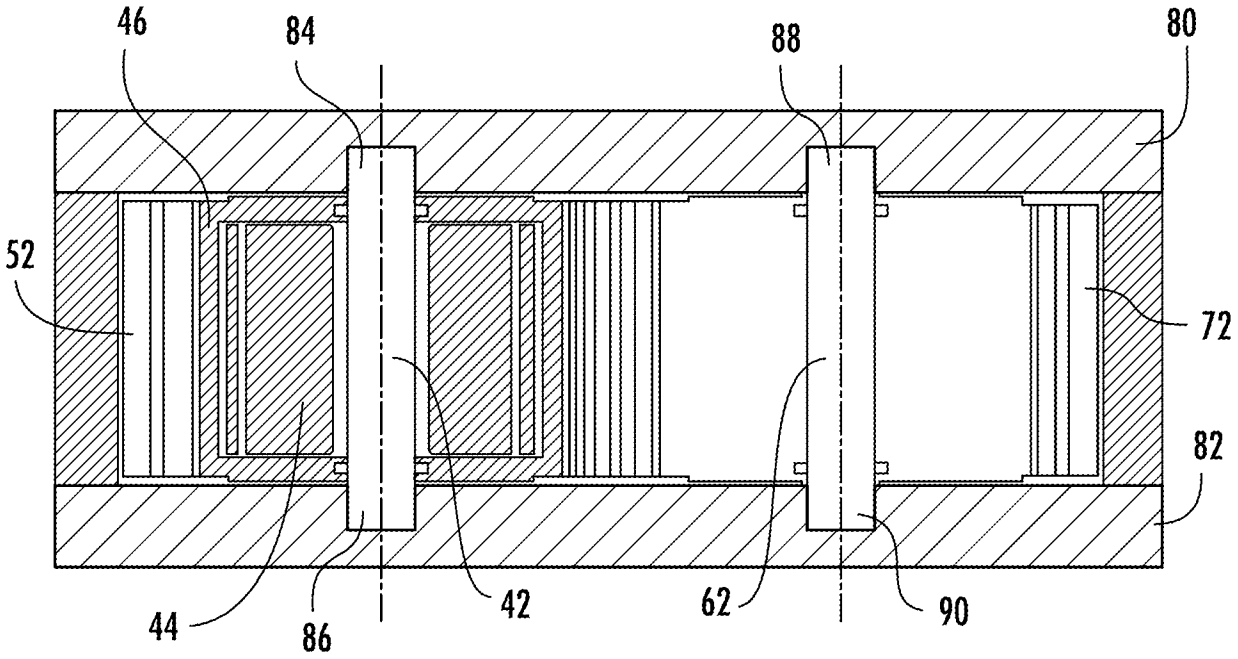
FIG. 2B shows a side cross-sectional view taken along a line A-A in FIG. 2.

FIG. 2 shows a top cross-sectional view of the external gear pump 10 of FIG. 1. FIG. 2B shows a side cross-sectional view taken along a line A-A in FIG. 2 of the external gear pump 10. As seen in FIGS. 2 and 2B, fluid driver 40 is disposed in the casing 20. The support shafts 42, 62 of the fluid driver 40 are disposed between the port 22 and the port 24 of the casing 20 and are supported by the upper plate 80 at one end 84 and the lower plate 82 at the other end 86. The support shaft 42 supports the motor 41 and gear 50 when assembled. The support shaft 62 supports gear 70 when assembled. The means to support the shafts 42, 62 and thus the fluid driver 40 is not limited to the illustrated design and other designs to support the shaft can be used. For example, either or both of shafts 42, 62 can be supported by blocks that are attached to the casing 20 rather than directly by casing 20. The support shaft 42 is disposed in parallel with the support shaft 62 and the two shafts are separated by an appropriate distance so that the gear teeth 52, 72 of the respective gears 50, 70 mesh with each other when rotated.

The stator 44 of motor 41 is disposed radially between the support shaft 42 and the rotor 46. The stator 44 is fixedly connected to the support shaft 42, which is fixedly connected to the casing 20. The rotor 46 is disposed radially outward of the stator 44 and surrounds the stator 44. Thus, the motor 41 in this embodiment is of an outer-rotor motor design (or an external-rotor motor design), which means that that the outside of the motor rotates and the center of the motor is stationary. In contrast, in an internal-rotor motor design, the rotor is attached to a central shaft that rotates. Detailed description regarding an external-rotor motor is omitted herein for brevity as these features are known in the relevant art. In an exemplary embodiment, the electric motor 41 is a multi-directional motor. That is, the motor 41 can operate to create rotary motion either clockwise or counter-clockwise depending on operational needs. Further, in an exemplary embodiment, the motor 41 is a variable-speed and/or a variable-torque motor in which the speed/torque of the rotor and thus that of the attached gear can be varied to create various volume flows and pump pressures, as desired.

As discussed above, the gear body 50 can include cylindrical opening 51, which receives motor 41. In an exemplary embodiment, the fluid driver 40 can include outer support member 48 (see FIG. 2) which aids in coupling the motor 41 to the gear 50 and in supporting the gear 50 on motor 41. The support member 48 can be, for example, a sleeve that is initially attached to either an outer casing of the motor 41 or an inner surface of the cylindrical opening 51. The sleeves can be attached by using an interference fit, a press fit, an adhesive, screws, bolts, a welding or soldering method, or other means that can attach the support members to the cylindrical openings. Similarly, the final coupling between the motor 41 and the gear 50 using the support member 48 can be by using an interference fit, a press fit, screws, bolts, adhesive, a welding or soldering method, or other means to attach the motors to the support members. The sleeve can be made to different thicknesses as desired to, e.g., facilitate the attachment of motors with different physical sizes to the gear 50 or vice versa. In addition, if the motor casing and the gear are made of materials that are not compatible, e.g., chemically or otherwise, the sleeve can be made of materials that are compatible with both the gear composition and the motor casing composition. In some embodiments, the support member 48 can be designed as a sacrificial piece. That is, support member 48 is designed to be the first to fail, e.g., due to excessive stresses, temperatures, or other causes of failure, in comparison to the gear 50 and motor 41. This allows for a more economic repair of the pump 10 in the event of failure. In some embodiments, the outer support member 48 is not a separate piece but an integral part of the casing for the motor 41 or part of the inner surface of the cylindrical opening 51 of the gear 50. In other embodiments, the motor 41 can support the gear 50 (and the plurality of gear teeth 52) on its outer surface without the need for the outer support member 48. For example, the motor casing can be directly coupled to the inner surface of the cylindrical opening 51 of the gear 50 by using an interference fit, a press fit, screws, bolts, an adhesive, a welding or soldering method, or other means to attach the motor casing to the cylindrical opening. In some embodiments, the outer casing of the motor 41 can be, e.g., machined, cast, or other means to shape the outer casing to form a shape of the gear teeth 52. In still other embodiments, the plurality of gear teeth 52 can be integrated with the rotor 46 such that the gear/rotor combination forms one rotary body.

In the above discussed exemplary embodiments, fluid driver 40, including electric motor 41 and gears 50, 70, are integrated into a single pump casing 20. This novel configuration of the external gear pump 10 of the present disclosure enables a compact design that provides various advantages. First, the enclosed design means that there is less likelihood of contamination from outside the pump, e.g., through clearances in the shaft seals as in conventional pumps. Also, the space or footprint occupied by the gear pump embodiments discussed above is significantly reduced by integrating necessary components into a single pump casing, when compared to conventional gear pumps. In addition, the total weight of a pump system consistent with the above embodiments is also reduced by removing unnecessary parts such as a shaft that connects a motor to a pump, and separate mountings for a motor/gear driver. Further, since the pump 10 of the present disclosure has a compact and modular design, it can be easily installed, even at locations where conventional gear pumps could not be installed, and can be easily replaced. Detailed description of the pump operation is provided next.

FIG. 2 illustrates an exemplary fluid flow path of an exemplary embodiment of the external gear pump 10. The ports 22, 24, and a meshing area 78 between the plurality of first gear teeth 52 and the plurality of second gear teeth 72 are substantially aligned along a single straight path. However, the alignment of the ports are not limited to this exemplary embodiment and other alignments are permissible. For explanatory purpose, the gear 50 is rotatably driven clockwise 74 by motor 41 and the gear 70 is rotatably driven counter-clockwise 76 by the motor 61. With this rotational configuration, port 22 is the inlet side of the gear pump 10 and port 24 is the outlet side of the gear pump 10. In some exemplary embodiments, both gears 50, 70 are respectively independently driven by the separately provided motors 41, 61. The gear 50 and the gear 70 are disposed in the casing 20 such that the gear 50 engages (or meshes) with the gear 70 when the rotor 46 is rotatably driven. More specifically, the plurality of gear teeth 52 mesh with the plurality of gear teeth 72 in a meshing area 78 such that the torque (or power) generated by the motor 41 is transmitted to the gear 50, which then drives gear 70 via gear meshing to carry the fluid from the port 22 to the port 24 of the pump 10.

As seen in FIG. 2, the fluid to be pumped is drawn into the casing 20 at port 22 as shown by an arrow 92 and exits the pump 10 via port 24 as shown by arrow 96. The pumping of the fluid is accomplished by the gear teeth 52, 72. As the gear teeth 52, 72 rotate, the gear teeth rotating out of the meshing area 78 form expanding inter-tooth volumes between adjacent teeth on each gear. As these inter-tooth volumes expand, the spaces between adjacent teeth on each gear are filled with fluid from the inlet port, which is port 22 in this exemplary embodiment. The fluid is then forced to move with each gear along the interior wall 90 of the casing 20 as shown by arrows 94 and 94'. That is, the teeth 52 of gear 50 force the fluid to flow along the path 94 and the teeth 72 of gear 70 force the fluid to flow along the path 94'. Very small clearances between the tips of the gear teeth 52, 72 on each gear and the corresponding interior wall 90 of the casing 20 keep the fluid in the inter-tooth volumes trapped, which prevents the fluid from leaking back towards the inlet port. As the gear teeth 52, 72 rotate around and back into the meshing area 78, shrinking inter-tooth volumes form between adjacent teeth on each gear because a corresponding tooth of the other gear enters the space between adjacent teeth. The shrinking inter-tooth volumes force the fluid to exit the space between the adjacent teeth and flow out of the pump 10 through port 24 as shown by arrow 96. In some embodiments, the motor 41 is bi-directional and the rotation of motor 41 can be reversed to reverse the direction fluid flow through the pump 10, i.e., the fluid flows from the port 24 to the port 22.

To prevent backflow, i.e., fluid leakage from the outlet side to the inlet side through the meshing area 78, the meshing between a tooth of the gear 50 and a tooth of the gear 70 in the meshing area 78 provides sealing against the backflow. Thus, along with driving gear 70, the meshing force from gear 50 will seal (or substantially seal) the backflow path, i.e., as understood by those skilled in the art, the fluid leakage from the outlet port side to the inlet port side through the meshing area 78 is substantially eliminated.

FIG. 2B schematically shows gear meshing between two gears 50, 70 in the gear meshing area 78 in an exemplary embodiment. As discussed above in reference to FIG. 2A, it is assumed that the rotor 46 is rotatably driven clockwise 74 by the rotor 46. The plurality of first gear teeth 52 are rotatably driven clockwise 74 along with the rotor 46 and the plurality of second gear teeth 72 are rotatably driven counter-clockwise 76 via gear meshing. In particular, FIG. 2B exemplifies that the gear tooth profile of the first and second gears 50, 70 is configured such that the plurality of first gear teeth 52 are in surface contact with the plurality of second gear teeth 72 at three different contact surfaces CS1, CS2, CS3 at a point in time. However, the gear tooth profile in the present disclosure is not limited to the profile shown in FIG. 2B. For example, the gear tooth profile can be configured such that the surface contact occurs at two different contact surfaces instead of three contact surfaces, or the gear tooth profile can be configured such that a point, line or an area of contact is provided. In some exemplary embodiments, the gear teeth profile is such that a small clearance (or gap) is provided between the gear teeth 52, 72 to release pressurized fluid, i.e., only one face of a given gear tooth makes contact with the other tooth at any given time. Such a design retains the sealing effect while ensuring that excessive pressure is not built up. Thus, the gear tooth profile of the first and second gears 50, 70 can vary without departing from the scope of the present disclosure.

In addition, depending on the type of fluid displacement member, the meshing can be between any surface of at least one projection (e.g., bump, extension, bulge, protrusion, other similar structure or combinations thereof) on the first fluid displacement member and any surface of at least one projection (e.g., bump, extension, bulge, protrusion, other similar structure or combinations thereof) or an indent (e.g., cavity, depression, void or similar structure) on the second fluid displacement member. In some embodiments, at least one of the fluid displacement members can be made of or include a resilient material, e.g., rubber, an elastomeric material, or another resilient material, so that the meshing force provides a more positive sealing area.

Figure 3:
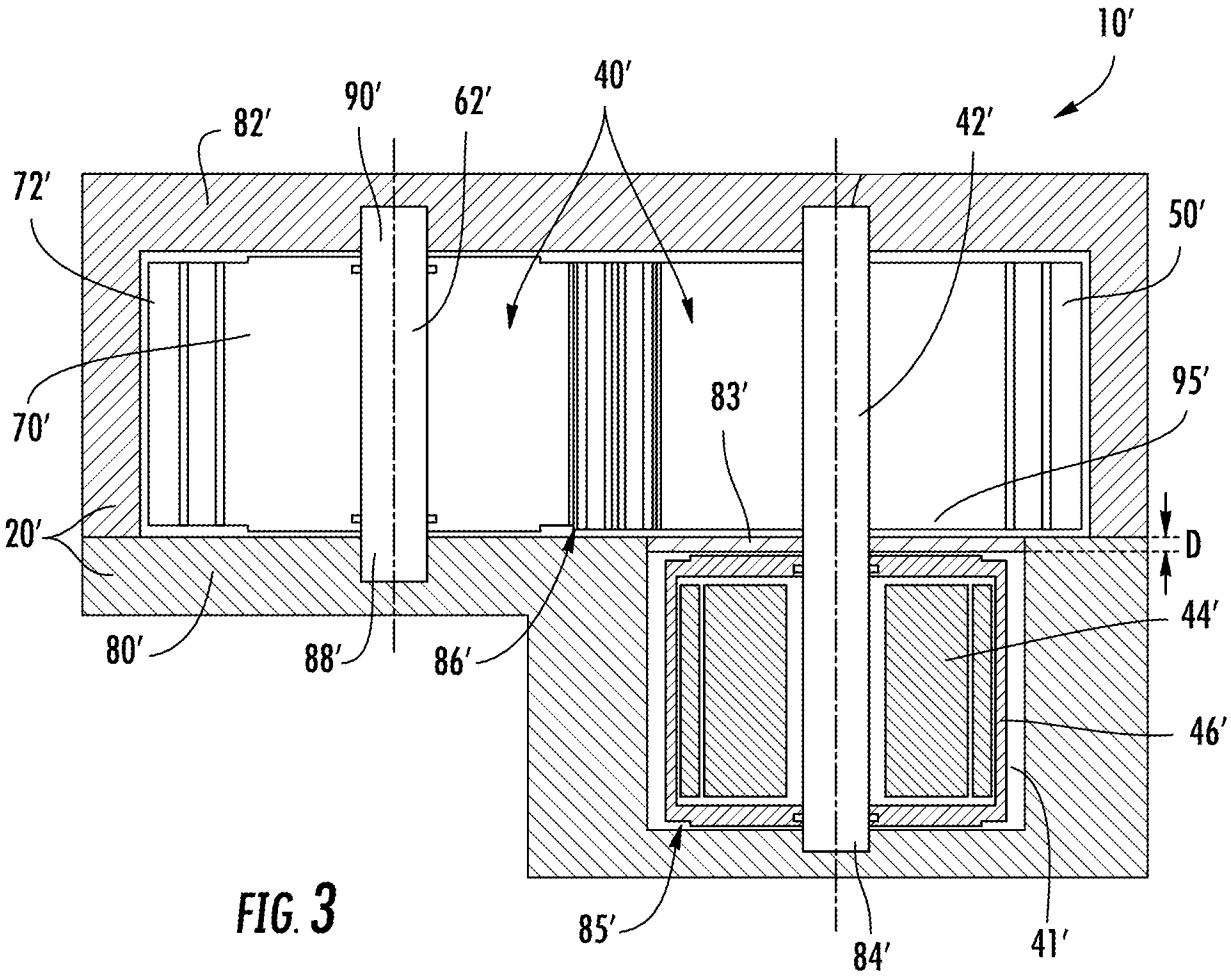
FIG. 3 shows a side cross-sectional view taken of another exemplary embodiment of the present invention.

In the embodiments discussed above, the prime mover is disposed inside the fluid displacement member, i.e., motor 41 is disposed inside the cylinder opening 51 of gear 50. However, advantageous features of the inventive pump design are not limited to a configuration in which the prime mover is disposed within the body of the fluid displacement member. Other configurations also fall within the scope of the present disclosure. For example, FIG. 3 shows a side cross-sectional view of another exemplary embodiment of an external gear pump 10'. The embodiment of the pump 10' shown in FIG. 3 differs from pump 10 (FIG. 1) in that the motor in this embodiment is external to the corresponding gear body but is still in the pump casing. The pump 10' includes a casing 20', a fluid driver 40'. The fluid driver 40' includes motor 41' and gears 50' and 70'. The inner surface of the casing 20' defines an internal volume that includes a motor cavity 85' and a gear cavity 86'. The casing 20' can include end plates 80', 82'. These two plates 80', 82' can be connected by a plurality of bolts (not shown).

The gear 70' includes a plurality of gear teeth 72' extending radially outward from its gear body. The 70' is disposed next to gear 50' such that the respective gear teeth 72', 52' meshes with each other in a manner similar to the meshing of gear teeth 52, 72 in meshing area 78 discussed above with respect to pump 10. In this embodiment, motor 41' is an inner-rotor motor design and is disposed in the motor cavity 85'. In this embodiment, the motor 41' and the gear 50' have a common shaft 42'. The rotor 44' of motor 41' is disposed radially between the shaft 42' and the stator 46'. The stator 46' is disposed radially outward of the rotor 44' and surrounds the rotor 44'. The inner-rotor design means that the shaft 42', which is connected to rotor 44', rotates while the stator 46' is fixedly connected to the casing 20'. In addition, gear 50' is also connected to the shaft 42'. The shaft 42' is supported by, for example, a bearing in the plate 80' at one end 84' and by a bearing in the plate 82' at the other end. Similarly, the shaft 62' of gear 70' is supported by a bearing in plate 80' at one end 88' and by a bearing in plate 82' at the other end 90'. In other embodiments, one or both shafts 42' and 62' can be supported by bearing blocks that are fixedly connected to the casing 20' rather than directly by bearings in the casing 20'. In addition, rather than a common shaft 42', the motor 41' and the gear 50' can include their own shafts that are coupled together by known means. In addition, the shaft 42' may include one or more hubs along the axial direction, for example, to reinforce the shaft strength or avoid any vibration issues.

As shown in FIG. 3, the gear 50' is disposed adjacent to the motor 41' in the casing 20'. That is, unlike motor 41, the motor 41' is not disposed in the gear body of the gear. The gear 50' is spaced apart from the motor 41' in an axial direction on the shaft 42'. For example, in the embodiment shown in FIG. 3, the gear 50' is spaced apart from the motor 41' by a distance D in the axial direction of the support shaft 42. The rotor 44' is fixedly connected to the shaft 42' on one side 84' of the shaft 42', and the gear 50' is fixedly connected to the shaft 42' on the other side 86' of the shaft 42' such that torque generated by the motor 41' is transmitted to the gear 50' via the shaft 42'.

The motor 41' is designed to fit into its cavity 85' with sufficient tolerance between the motor casing and the pump casing 20' so that fluid is prevented (or substantially prevented) from entering the cavity 85' during operation. In addition, there is sufficient clearance between the motor casing and the gear 50' for the gear 50' to rotate freely but the clearance is such that the fluid can still be pumped efficiently. Thus, with respect to the fluid, in this embodiment, the motor casing is designed to perform the function of the appropriate portion of the pump casing walls of the embodiment of FIG. 1. In some embodiments, the diameter of the cavity 85' opening and thus the outer diameter of the motor 41' is equal to or less than the root diameter for the gear teeth 52'. Thus, in these embodiments, even the motor side of the gear teeth 52' will be adjacent to a wall of the pump casing 20' as they rotate. In some embodiments, a bearing 95' can be inserted between the gear 50' and the motor 41'. The bearing 95', which can be, e.g., a washer-type bearing, decreases friction between the gear 50' and the casing of motor 41' as the gear 50' rotates. Depending on the fluid being pumped and the type of application, the bearing can be metallic, a non-metallic or a composite. Metallic material can include, but is not limited to, steel, stainless steel, anodized aluminum, aluminum, titanium, magnesium, brass, and their respective alloys. Non-metallic material can include, but is not limited to, ceramic, plastic, composite, carbon fiber, and nano-composite material. In addition, the bearing 95' can be sized to fit the motor cavity 85' opening to help seal the motor cavity 85' from the gear cavity 86', and the gears 50', 70' will be able to pump the fluid more efficiently. It should be understood that those skilled in the art will recognize that, in operation, the fluid driver 40' will operate in a manner similar to that disclosed above with respect to pump 10. Accordingly, for brevity, pump 10' operating details will not be further discussed.

In the above exemplary embodiment, the gear 50' is shown as being spaced apart from the motor 41' along the axial direction of the shaft 42'. However, other configurations fall within the scope of the present disclosure. For example, the gear 50' and motor 41' can be completely separated from each other (e.g., without a common shaft), partially overlapping with each other, positioned side-by-side, on top of each other, or offset from each other. Thus, the present disclosure covers all of the above-discussed positional relationships and any other variations of a relatively proximate positional relationship between a gear and a motor inside the casing 20'. In addition, in some exemplary embodiments, motor 41' can be an outer-rotor motor design that is appropriately configured to rotate the gear 50'.

Further, in the exemplary embodiment described above, the torque of the motor 41' is transmitted to the gear 50' via the shaft 42'. However, the means for transmitting torque (or power) from a motor to a gear is not limited to a shaft, e.g., the shaft 42' in the above-described exemplary embodiment. Instead, any combination of power transmission devices, e.g., shafts, sub-shafts, belts, chains, couplings, gears, connection rods, cams, or other power transmission devices, can be used without departing from the spirit of the present disclosure.

Figure 4:
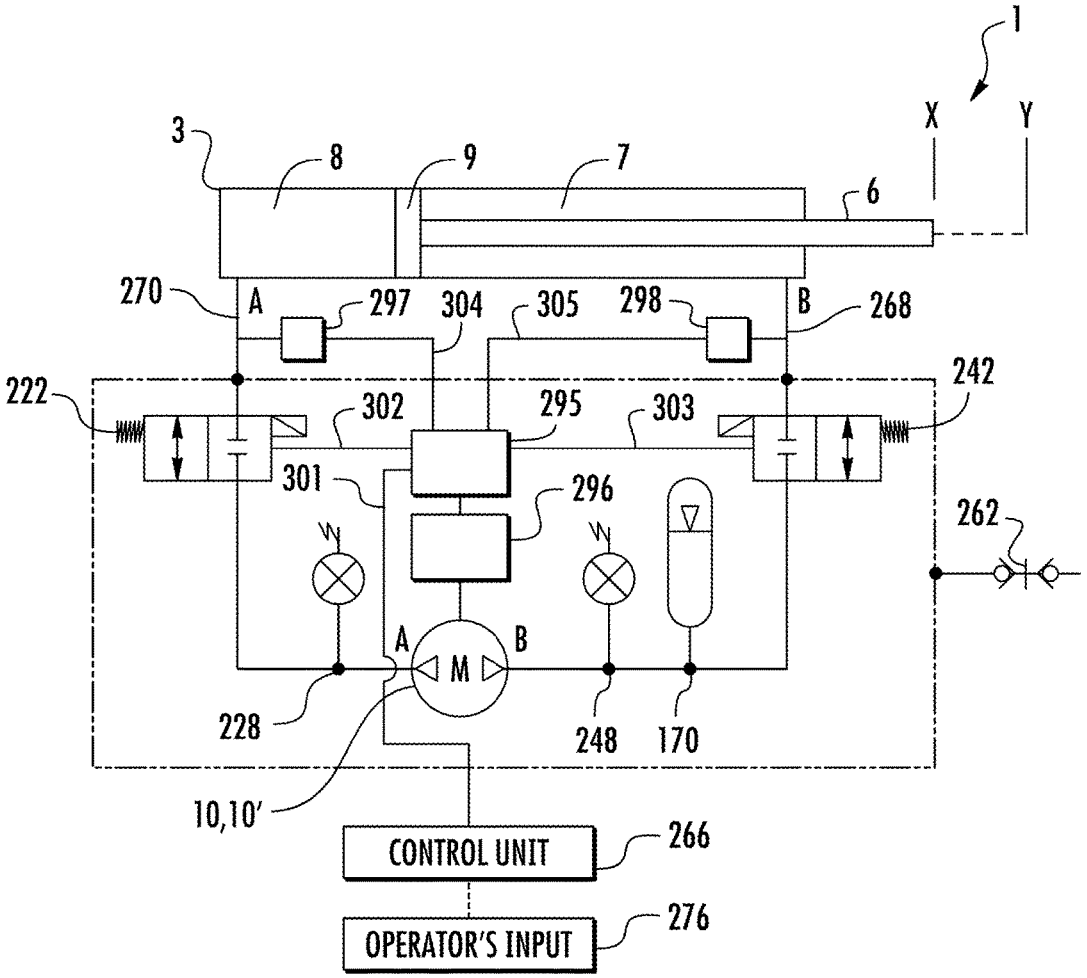
FIG. 4 is a schematic diagram illustrating an exemplary embodiment of a fluid system in a linear actuator application.

Because the exemplary embodiments of the pumps described above can be a variable-speed and/or a variable torque pump, systems incorporating these pumps can be simplified. That is, complex flow directional valves and variable-piston pumps can be replaced with exemplary embodiments of the pump described above. For example, FIG. 4 illustrates a closed-loop linear system 1 that incorporates an exemplary embodiment of the pump 10. For clarity and brevity, the system in FIG. 4 will be described as closed-loop hydraulic system in which pump 10 operates a linear hydraulic cylinder 3. However, those skilled in the art would understand that pump 10' with motor 41' can also be incorporated into the exemplary systems described below. In addition, it should be understood that the inventive pump and system are not limited to a hydraulic pump or a hydraulic system and that the inventive pump can be incorporated into other fluid systems. The linear system 1 of FIG. 4 includes a hydraulic cylinder 3, a hydraulic pump 10, valve assemblies 222, 242, storage device 170 (e.g., a pressurized vessel), a control unit 266, a drive unit 295, and a power supply 296. In the closed-loop hydraulic system 1, the fluid discharged from either the retraction chamber 7 or the extraction chamber 8 of the hydraulic cylinder 3 is directed back to the pump 10 and immediately recirculated to the other chamber. A coupling connector 262 may be provided at one or more locations in the system 1. This connector 262 may be used for obtaining hydraulic fluid samples, calibrating the hydraulic system pressure, adding, removing, or changing hydraulic fluid, or trouble-shooting any hydraulic fluid related issues. Although the illustrated exemplary embodiment is a closed-loop system, the pump 10 can also be incorporated in an open-loop system. In an open-loop hydraulic system, the fluid discharged from a chamber is typically directed back to a sump and subsequently drawn from the sump by a pump.

In the system of FIG. 4, the valve assembly 242 is disposed between port B of the hydraulic pump 10 and the retraction chamber 7 of the hydraulic cylinder 3 and the second valve assembly 222 is disposed between port A of the hydraulic pump 10 and the extraction chamber 8 of the hydraulic cylinder 3. The valve assemblies 222, 242 and hydraulic pump 10 are powered by a common power supply 296. In some embodiments, the pump 10 and the valves assemblies 222, 242 can be powered separately or each valve assembly 222, 242 and pump 10 can have its own power supply. In some embodiments, the valve assemblies 222, 242 can include lock valves that are either fully open or closed (i.e. switchable between a fully open state and a fully closed state). In other embodiments, the valves in valve assemblies 222, 242 can be set to intermediate positions between 0% and 100%. In the illustrated embodiment, the valve assemblies 222, 242 are shown external to the hydraulic pump casing with one valve assembly located on each side of the hydraulic pump 10 along the flow direction. However, in some embodiments, the valve assemblies 222, 242 can be disposed internal to the hydraulic pump casing 20. It should be understood however that, while the valves in valves assemblies 222, 242 can be set to a desired position at the start and end of a given hydraulic system operation, in some embodiments, the valves are not used to control the flow or pressure during the operation. That is, the valves in valves assemblies 222, 242 will remain at the set position during a given operation, e.g., at full open or another desired position at the start of the operation. During the hydraulic system operation, in some embodiments, the control unit 266 will control the speed and/or torque of the motor 41 to exclusively adjust the flow and/or pressure in the hydraulic system. In this way, the complexity of conventional systems that use, e.g., directional flow valves and variable-flow piston pumps can be eliminated, which will also provide a more reliable system in terms of maintenance and control.

The system 1 can include one or more process sensors therein. For example sensor assemblies 297 and 298 can include one or more sensors to monitor the system operational parameters. The sensor assemblies 297, 298 can communicate with the control unit 266 and/or drive unit 295 (as illustrated in FIG. 4). Each sensor assembly 297, 298 can include at least one of a pressure transducer, a temperature transducer, and a flow transducer (i.e., a pressure transducer, a temperature transducer, a flow transducer, or any combination of the transducers therein). Signals from the sensor assemblies 297, 298 can be used by the control unit 266 and/or drive unit 295 for monitoring and for control purposes. The status of each valve assembly 222, 242 (e.g., the appropriate operational status—open or closed, percent opening, or some other valve status indication) and the process data measured by the sensors in sensor assemblies 297, 298 (e.g., measured pressure, temperature, flow rate or other system parameters) may be communicated to the drive unit 295 via the respective communication connections 302-305.

As discussed above, the hydraulic pump 10 includes a motor 41. The motor 41 is controlled by the control unit 266 via the drive unit 295 using communication connection 301. In some embodiments, the functions of drive unit 295 can be incorporated into the motor 41 and/or the control unit 266 such that the control unit 266 communicates directly with motor 41. In addition, the valve assemblies 222, 242 can also be controlled (e.g., open/close) by the control unit 266 via the drive unit 295 using communication connections 301, 302, and 303. In some embodiments, the functions of drive unit 295 can be incorporated into the valve assemblies 222, 242 and/or control unit 266 such that the control unit 266 communicates directly with valve assemblies 222, 242. The drive unit 295 can also process the communications between the control unit 266 and the sensor assemblies 297, 298 using communication connections 304 and 305. In some embodiment, the control unit 266 can be set up to communicate directly with the sensor assemblies 297, 298. The data from the sensors can be used by the control unit 266 and/or drive unit 295 to control the motor 41 and/or the valve assemblies 222, 242. For example, based on the process data measured by the sensors in sensor assemblies 297, 298, the control unit 266 can provide command signals to the valve assemblies to, e.g., open/close the lock valves in the valve assemblies 222, 242 (or move the valves to a desired percent opening) in addition to controlling a speed and/or torque of motor 41.

The drive unit 295 includes hardware and/or software that "interprets" the command signals from the control unit 266 and sends the appropriate demand signals to the motor 41 and/or valve assemblies 222, 242. For example, the drive unit 295 can include pump and/or motor curves that are specific to the hydraulic pump 10 such that command signals from the control unit 266 will be converted to appropriate speed/torque demand signals to the hydraulic pump 10 based on the design of the hydraulic pump 10. Similarly, the drive unit 295 can include valve and/or actuator curves that are specific to the valve assemblies 222, 242 and the command signals from the control unit 266 will be converted to the appropriate demand signals based on the type of valve. The pump/motor and/or the valve/actuator curves can be implemented in hardware and/or software, e.g., in the form of hardwire circuits, software algorithms and formulas, or some other hardware and/or software system that appropriately converts the demand signals to control the pump/motor and/or the valve/actuator.

In some embodiments, the drive unit 295 can include application specific hardware circuits and/or software (e.g., algorithms) to control the motor 41 and/or valve assemblies 222, 242. For example, in some applications, the linear system 1 may control the boom of an excavator. In such a system, the drive unit 295 can include circuits, algorithms, protocols (e.g., safety, operational), look-up tables or some other type of hardware and/or software systems that are specific to the operation of the boom. Thus, a command signal from the control unit 266 can be interpreted by the drive unit 295 to appropriately control the motor 41 and/or valve assemblies 222, 242 to position the boom at a desired position.

The control unit 266 can receive feedback data from the motor 41. For example, the control unit 266 can receive speed or frequency values, torque values, current and voltage values, or other values related to the operation of the motor 41. In addition, the control unit 266 can receive feedback data from the valve assemblies 222, 242. For example, the control unit 266 can receive the open and close status of the lock valves 222, 242. In some embodiments, the lock valves 222, 242 can have a percent opening indication instead of or in addition to an open/close indication to e.g., provide status of a partially open valve. In addition, depending on the type of valve actuator, the control unit 266 can receive feedbacks such as speed and/or position of the actuator. Further, the control unit 266 can receive feedback of process parameters such as pressure, temperature, flow, or some other process parameter. As discussed above, in the exemplary embodiment illustrated in FIG. 4, each sensor assembly 297, 298 can have one or more sensors to measure process parameters such as pressure, temperature, and flow rate of the hydraulic fluid. The illustrated sensor assemblies 297, 298 are shown disposed next to the ports A and B of the hydraulic cylinder 3. However, the sensor assemblies 297, and 298 are not limited to this location. Alternatively, or in addition to sensor assemblies 297, 298, the hydraulic system can have other sensors throughout the system 1 to measure process parameters such as, e.g., pressure, temperature, flow, or some other process parameter. For example, pump 10 can include separate pressure sensors 228 and 248 at ports A and B, respectively, to separately monitor the system and/or the pump 10.

Although the drive unit 295 and control unit 266 are shown as separate controllers in FIG. 4, the functions of these units can be incorporated into a single controller or further separated into multiple controllers (e.g., the motor 41 and valve assemblies 222, 242 can have a common controller or each component can have its own controller). The controllers (e.g., control unit 266, drive unit 295 and/or other controllers) can communicate with each other to coordinate the operation of the valve assemblies 222, 242 and the hydraulic pump 10. For example, as illustrated in FIG. 4, the control unit 266 communicates with the drive unit 295 via a communication connection 301. The communications can be digital based or analog based (or a combination thereof) and can be wired or wireless (or a combination thereof). In some embodiments, the control system can be a "fly-by-wire" operation in that the control and sensor signals between the control unit 266, the drive unit 295, the valve assemblies 222, 242, hydraulic pump 10, sensor assemblies 297, 298 are entirely electronic or nearly all electronic. That is, the control system does not use hydraulic signal lines or hydraulic feedback lines for control, e.g., the actuators in valve assemblies 222, 242 do not have hydraulic connections for pilot valves. In some exemplary embodiments, a combination of electronic and hydraulic controls can be used.

The control unit 266 may receive inputs from an operator's input unit 276. Using the input unit 276, the operator can manually control the system or select pre-programmed routines. For example, the operator can select a mode of operation for the system such as flow (or speed) mode, pressure (or torque) mode, or a balanced mode. Flow or speed mode may be utilized for an operation where relatively fast retraction or extraction of the piston rod 6 is requested with relatively low torque requirement. Conversely, a pressure or torque mode may be utilized for an operation where relatively slow retraction or extraction of the piston rod 6 is requested with a relatively high torque requirement. Based on the mode of operation selected and the type of valve in valve assemblies 222, 242, the control scheme for controlling the motor 41 and the valve assemblies 222, 242 can be different.

As discussed above, in some embodiments, the valve assemblies 222, 242 can include lock valves, i.e. the valves designed to be either fully open or fully closed. In such systems, the control unit 266/drive unit 295 will fully open the valves and, in some embodiments, check for the open feedback prior to starting the motor 41. During normal operation, the lock valves of valve assemblies 222, 242 can be at 100% open or some other desired position, and the control unit 266/drive unit 295 controls the operation of the motor 41 to maintain the desired flow and/or pressure, as described further below. Upon shutdown or abnormal operation, the motor 41 are shut down and the valves in valve assemblies 222, 242 are closed or moved to some other desired position. During a normal shut down, the hydraulic pressure in the system may be allowed to drop before the valves are closed. However, in some abnormal operating conditions, based on safety protocol routines, the valves may be closed immediately after or substantially simultaneously with the motor 41 being turned off in order to trap the pressure in the system. For example, in some abnormal conditions, it might be safer to lock the hydraulic cylinder 3 in place by trapping the pressure on the extraction chamber 8 and the retraction chamber 7. In the application example give above, the boom will be locked in place rather than having the boom drop uncontrolled. The safety protocol routines may be hardwired circuits or software algorithms in control unit 266 and/or drive unit 295.

In the exemplary system of FIG. 4, when the control unit 266 receives a command to extract the cylinder rod 6, for example in response to an operator's command, the control unit 266 controls the speed and/or torque of the pump 10 to transfer pressurized fluid from the retraction chamber 7 to the extraction chamber 8. That is, pump 10 pumps fluid from port B to port A. In this way, the pressurized fluid in the retraction chamber 7 is drawn, via the hydraulic line 268, into port B of the pump 10 and carried to the port A and further to the extraction chamber 8 via the hydraulic line 270. By transferring fluid and increasing the pressure in the extraction chamber 8, the piston rod 6 is extended. During this operation of the pump 10, the pressure in the port B side of the pump 10 can become lower than that of the storage device (i.e. pressurized vessel) 170. When this happens, the pressurized fluid stored in the storage device 170 is released to the port B side of the system so that the pump does not experience cavitation. The amount of the pressurized fluid released from the storage device 170 can correspond to a difference in volume between the retraction and extraction chambers 7, 8 due to the volume the piston rod occupies in the retraction chamber 7.

When the control unit 266 receives a command to retract the cylinder rod 6, for example in response to an operator's command, the control unit 266 controls the speed and/or torque of the pump 10 to transfer pressurized fluid from the extraction chamber 8 to the retraction chamber 7. That is, pump 10 pumps fluid from port A to port B. In this way, the pressurized fluid in the extraction chamber 8 is drawn, via the hydraulic line 268, into the port A of the pump 10 and carried to the port B and further to the retraction chamber 7 via the hydraulic line 268. By transferring fluid and increasing the pressure in the retraction chamber 7, the piston rod 6 is retracted. During this operation of the pump 10, the pressure in the port B side of the pump 10 can become higher than that of the storage device (i.e. pressurized vessel) 170. Thus, a portion of the fluid carried from the extraction chamber 8 is replenished back to the storage device 170. The amount of the pressurized fluid replenished back to the storage device 170 may correspond to a difference in volume between the retraction and extraction chambers 7, 8 due to the volume the piston rod occupies in the retraction chamber 7.

The control unit 266 that controls motor 41 can have multiple operational modes. For example, a speed/flow mode, a torque/pressure mode, or a combination of both. A speed/flow mode may be utilized for an operation where relatively fast retraction or extraction of the piston rod 6 is requested with relatively low torque requirement. Conversely, a torque/pressure mode may be utilized for an operation where relatively slow retraction or extraction of the piston rod 6 is requested with a relatively high torque requirement. Operation of the system 1 will be discussed further below.

As discussed above, hydraulic pump 10 includes fluid driver 40 with motor 41. Preferably, the motor 41 is a variable speed/variable torque, bi-directional motor. Depending on the desired mode of operation, e.g. as set by the operator or as determined by the system based on the application (e.g., boom application, etc.), the flow and/or pressure of the system can be controlled to a desired set-point value by controlling either the speed or torque of the motor. For example, in flow (or speed) mode operation, the control unit 266/drive unit 295 controls the flow in the system by controlling the speed of the motor 41. When the system is in pressure (or torque) mode operation, the control unit 266/drive unit 295 controls the pressure at a desired point in the system, e.g., at the chambers 7, 8, by adjusting the torque of the hydraulic pump motor 41. When the system is in a balanced mode of operation, the control unit 266/drive unit 295 takes both the system's pressure and hydraulic flow rate into account when controlling the motor 41. Because the pump is not run continuously at a high rpm as in conventional systems, the temperature of the fluid remains relatively low thereby eliminating the need for a large fluid reservoir. In some embodiments, in each of these modes, the speed and/or torque of the pump 10 can be controlled to exclusively adjust the flow and/or pressure in the system.

The pressure/torque mode operation can be used to ensure that either the extraction chamber 8 or retraction chamber 7 of the hydraulic cylinder 3 is maintained at a desired pressure (or any other point in the hydraulic system). In pressure/torque mode operation, the power to the hydraulic pump motor 41 is determined based on the system application requirements using criteria such as maximizing the torque of the motors. If the hydraulic pressure is less than a predetermined set-point at the extraction chamber 8 side (e.g., at the location of sensor assembly 297) of the hydraulic pump 10, the control unit 266/drive unit 295 will increase the hydraulic pump's motor current (and thus the torque of the hydraulic motor) to increase the hydraulic pressure. If the pressure at sensor assembly 297 is less than the desired pressure, the control unit 266/drive unit 295 will decrease the current of motor 41 (and thus the torque) to reduce the hydraulic pressure. While the pressure at sensor assembly 297 is used in the above-discussed exemplary embodiment, pressure mode operation is not limited to measuring the pressure at a single location. Instead, the control unit 266/drive unit 295 can receive pressure feedback signals from multiple locations in the system for control.

In flow/speed mode operation, the power to the motor 41 is determined based on the system application requirements using criteria such as how fast the motor 41 ramps to the desired speed and how precisely the motor speed can be controlled. Because the fluid flow rate is proportional to the motor speed and the fluid flow rate determines the travel speed of the hydraulic cylinder 3, the control unit 266 can be configured to control the travel speed of the hydraulic cylinder 3 based on a control scheme that uses the motor speed, the flow rate, or some combination of the two. That is, when a specific response time of the hydraulic cylinder 3 is required, the control unit 266/drive unit 295 can control the motor 41 to achieve a predetermined speed and/or a predetermined hydraulic flow rate that corresponds to the desired response time for the hydraulic cylinder 3. For example, the control unit 266/drive unit 295 can be set up with algorithms, look-up tables, or some other type of hardware and/or software functions to correlate the speed of the hydraulic cylinder 3 to the speed of the hydraulic pump 10 and/or the flow of the hydraulic fluid. Thus, if the system requires that the hydraulic cylinder 3 move from position X to position Y (see FIG. 4) in a predetermined time period, i.e., at a desired speed, the control unit 266/drive unit 295 can be set up to control either the speed of the motor 41 or the hydraulic flow rate in the system to achieve the desired travel speed of the hydraulic cylinder 3.

If the control scheme uses the flow rate, the control unit 266/drive unit 295 can receive a feedback signal from a flow sensor, e.g., a flow sensor in one or both of sensor assembly 297, 298, to determine the actual flow in the system. The flow in the system may be determined by measuring, e.g., the differential pressure across two points in the system, the signals from an ultrasonic flow meter, the frequency signal from a turbine flow meter, or by using some other type of flow sensor or instrument. Thus, in systems where the control scheme uses the flow rate, the control unit 266/drive unit 295 can control the flow output of the hydraulic pump 10 to a predetermined flow set-point value that corresponds to the desired travel speed of the hydraulic cylinder 3.

Similarly, if the control scheme uses the motor speed, the control unit 266/drive unit 295 can receive speed feedback signals from the fluid driver 40. For example, the actual speed of the motor 41 can be measured by sensing the rotation of the pump gears. For example, the hydraulic pump 10 can include a magnetic sensor (not shown) that senses the gear teeth as they rotate. Alternatively, or in addition to the magnetic sensor (not shown), one or more teeth can include magnets that are sensed by a pickup located either internal or external to the hydraulic pump casing 20. Thus, in systems where the control scheme uses the flow rate, the control unit 266/drive unit 295 can control the actual speed of the hydraulic pump 10 to a predetermined speed set-point that corresponds to the desired travel speed of the hydraulic cylinder 3.

Alternatively, or in addition to the controls described above, the speed of the hydraulic cylinder 3 can be measured directly and compared to a desired travel speed set-point to control the speed of motor 41 in the fluid driver 40.

As discussed above, the control unit 266/drive unit 295 can include motor and/or valve curves. In addition, the hydraulic cylinder 3 can also have characteristic curves that describe the operational characteristics of the cylinder, e.g., curves that correlate pressure/flow with travel speed/position. The characteristic curves of the motor 41, valve assemblies 222, 242, and the hydraulic cylinder 3 can be stored in memory, e.g. RAM, ROM, EPROM, or some other type of storage device in the form of look-up tables, formulas, algorithms, or some other type of software implementation in the control unit 266, drive unit 295, or some other storage that is accessible to the control unit 266/drive unit 295 (e.g., in the fluid driver 40, valve assemblies 222, 242, and/or the hydraulic cylinder 3). The control unit 266/drive unit 295 can then use the characteristic curves to precisely control the motor 41 and/or the valves in valve assemblies 222, 242.

Figure 5:
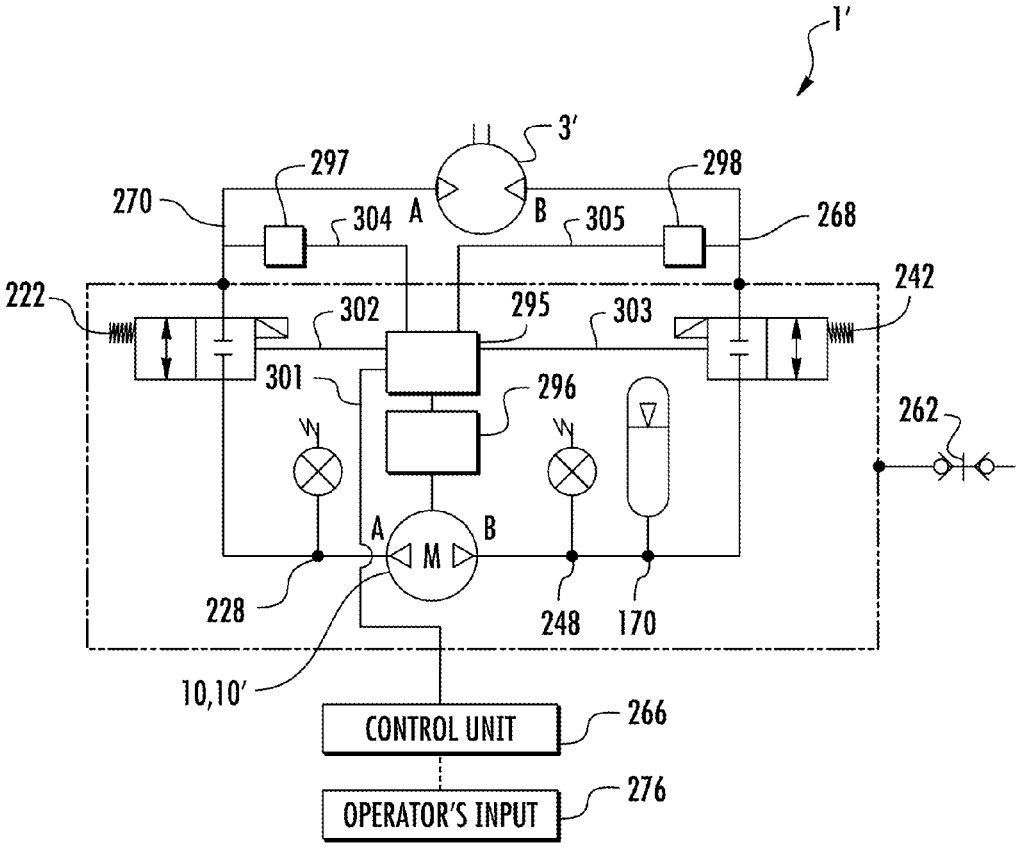
FIG. 5 is a schematic diagram illustrating an exemplary embodiment of a fluid system in a hydrostatic transmission application.

FIG. 5 illustrates another exemplary system application directed to a hydrostatic transmission system 1'. The difference in system 1' from that of system 1 is that the pump 10 operates a hydraulic motor 3' instead of a hydraulic cylinder 3. Accordingly, for brevity, a detailed description of the components in the system 1' is omitted except as necessary to describe the operation of hydraulic motor 3'.

In some applications, the hydrostatic transmission 1' can be part of small to heavy-duty equipment ranging from power tools to large construction equipment such as, e.g., excavators. The drive unit 295 and/or control unit 266 can include circuits, algorithms, protocols (e.g., safety, operational), look-up tables, or some other type of hardware and/or software systems that are specific to the equipment being operated, e.g., specific to excavator operation. Thus, a command signal from the control unit 266 can be interpreted by the drive unit 295 to appropriately control the motor 41 and/or valve assemblies 222, 242 to run the hydraulic motor 3' at, e.g., a desired rpm. or some other response of the hydraulic motor 3' that is specific to the application. Hydraulic motors are known in the art and therefore, for brevity, detailed description of the hydraulic motor is omitted.

In some embodiments the drive unit 295 and/or the control unit 266 can include characteristic curves that take into account the performance characteristics of the hydraulic motor 3'. As in system 1 of FIG. 4, the control unit 266 can receive feedback data from the motor 41 (e.g., frequency, torque, current, voltage, or some other value related to the operation of the motor 41), feedback data from the valve assemblies 222, 242 (open and close status, percent opening, or some other valve status indication), and feedback data from the system process (e.g., temperature, pressure, flow, or some other process parameter).

The control unit 266 may receive inputs from an operator's input unit 276. Using the input unit 276, the operator can manually control the system or select pre-programmed routines. For example, the operator can select a mode of operation for the system such as flow (or speed) mode, pressure (or torque) mode, or a balanced mode. Flow or speed mode may be utilized for an operation where relatively fast operation of the hydraulic motor 3' is requested with relatively low torque requirement. Conversely, a pressure or torque mode may be utilized for an operation where relatively slow operation of the hydraulic motor 3' is requested with a relatively high torque requirement.

In some embodiments, the valve assemblies 222, 242 include lock valves. During normal operation, the lock valves can be at 100% open or some other desired value, and the control unit 266/drive unit 295 will control the operation of the motor 41 to maintain the desired flow or pressure, as described further below. Upon shutdown or abnormal operation, the motor 41 is shut down and the valves in valve assemblies 222, 242 are closed. During a normal shut down, the hydraulic pressure in the system may be allowed to drop before the lock valves are closed. However, in some abnormal operating conditions, based on safety protocol routines, the lock valves may be closed immediately after or substantially simultaneously with the motor 41 being turned off in order to trap the pressure in the system. For example, in some abnormal conditions, it might be safer to lock the hydraulic motor 3' in place by trapping the pressure on both the inlet and outlet. In other applications, only one of the lock valves may be closed. The safety protocol routines may be hardwired circuits or software algorithms in control unit 266 and/or drive unit 295.

As discussed above, hydraulic pump 10 includes fluid driver 40 with motor 41. Preferably, the motor 41 is a variable speed/variable torque, bi-directional motors. Depending on the desired mode of operation, e.g. as set by the operator or as determined by the system based on the application, the flow and/or pressure of the system can be controlled to a desired set-point value by controlling either the speed and/or torque of the motor. For example, in flow (or speed) mode operation, the control unit 266/drive unit 295 controls the flow in the system by controlling the speed of the hydraulic motors. When the system is in pressure (or torque) mode operation, the control unit 266/drive unit 295 controls the pressure at a desired point in the system, e.g., at port A and/or port B of the hydraulic motor 3', by adjusting the torque of the pump motor 41. When the system is in a balanced mode of operation, the control unit 266/drive unit 295 takes both the system's pressure and hydraulic flow rate into account when controlling the motor 41. Because the pump is not run continuously at a high rpm as in conventional systems, the temperature of the fluid remains relatively low thereby eliminating the need for a large fluid reservoir. In some embodiments, in each of these modes, the speed and/or torque of the pump 10 can be controlled to exclusively adjust the flow and/or pressure in the system.

For clarity, the following description is provided with pump 10 operated such that fluid is transferred from port B to port A of the pump 10. Of course, in some embodiments the pump 10 and hydraulic motor 3' are bi-directional. The pressure/torque mode operation can be used to ensure that inlet of the hydraulic motor 3' (e.g., port A of the hydraulic motor 3') is maintained at a desired pressure (or any other point in the hydraulic system). In pressure/torque mode operation, the power to the pump motor 41 is determined based on the system application requirements using criteria such as maximizing the torque of the motor. If the hydraulic pressure is less than a predetermined set-point at the outlet side of the hydraulic pump 10 (e.g., port A side of the pump 10 at the location of sensor assembly 297), the control unit 266/drive unit 295 will increase the current of motor 41 (and thus the torque) to increase the hydraulic pressure. If the pressure at the outlet of pump 10 is higher than the desired pressure, the control unit 266/drive unit 295 will decrease the current of motor 41 (and thus the torque) to reduce the hydraulic pressure. While the pressure at the location of sensor assembly 297 is used in the above-discussed exemplary embodiment, pressure mode operation is not limited to measuring the pressure at a single location. Instead, the control unit 266/drive unit 295 can receive pressure feedback signals from multiple locations in the system for control.

In flow/speed mode operation, the power to the motor 41 is determined based on the system application requirements using criteria such as how fast the motor 41 ramps to the desired speed and how precisely the motor speed of the pump 10 can be controlled. Because the fluid flow rate is proportional to the motor speed of the pump 10 and the fluid flow rate determines the rotational speed of the hydraulic motor 3', the control unit 266 can be configured to control the speed (i.e., rpm) of the hydraulic motor 3' based on a control scheme that uses the pump motor speed, the flow rate, or some combination of the two. That is, when a specific rpm of the hydraulic motor 3' is required, the control unit 266/drive unit 295 can control the motor 41 to achieve a predetermined speed and/or a predetermined hydraulic flow rate that corresponds to the desired rpm for the hydraulic motor 3'. For example, the control unit 266/drive unit 295 can be set up with algorithms, look-up tables, or other software functions to correlate the rpm of the hydraulic motor 3' to the speed of the hydraulic pump 10 and/or the flow of the hydraulic fluid. Thus, if the system requires that the hydraulic motor 3' run at a desired rpm, the control unit 266/drive unit 295 can be set up to control either the speed of the fluid driver 40 or the hydraulic flow rate in the system to achieve the desired rpm of the hydraulic motor 3'.

If the control scheme uses the flow rate, the control unit 266/drive unit 295 can receive a feedback signal from a flow sensor, e.g., flow sensor in one or both of sensor assemblies 297, 298, to determine the actual flow in the system. The flow in the system may be determined by measuring, e.g., the differential pressure across two points in the system, the signals from an ultrasonic flow meter, the frequency signal from a turbine flow meter, or by using some other type of flow sensor or instrument. Thus, in systems where the control scheme uses the flow rate, the control unit 266/drive unit 295 can control the flow output of the hydraulic pump 10 to a predetermined flow set-point value that corresponds to the desired rpm of the hydraulic motor 3'.

Similarly, if the control scheme uses the motor speed of the pump 10, the control unit 266/drive unit 295 can receive speed feedback signals from the fluid driver 40. For example, the actual speed of the motor 41 can be measured by sensing the rotation of the pump 10 gears. For example, the hydraulic pump 10 can include a magnetic sensor (not shown) that senses the gear teeth as they rotate. Alternatively, or in addition to the magnetic sensor (not shown), one or more teeth can include magnets that are sensed by a pickup located either internal or external to the hydraulic pump casing 20. Thus, in systems where the control scheme uses the flow rate, the control unit 266/drive unit 295 can control the actual speed of the hydraulic pump 10 to a predetermined speed set-point that corresponds to the desired rpm of the hydraulic motor 3'.

Alternatively, or in addition to the controls described above, the speed of the hydraulic motor 3' can be measured directly and compared to a desired rpm set-point of the hydraulic motor 3' to control the speed of the fluid driver 40.

As discussed above, the control unit 266/drive unit 295 can include motor and/or valve curves. In addition, the hydraulic motor 3' can also have characteristic curves that describe the operational characteristics of the motor that correlate pressure/flow/rpm. The characteristic curves of the motor 41, valve assemblies 222, 242, and the hydraulic motor 3' can be stored in memory, e.g. RAM, ROM, EPROM, etc. in the form of look-up tables, formulas, algorithms, or some other type of software implementation in the control unit 266, drive unit 295, or some other storage that is accessible to the control unit 266/drive unit 295 (e.g., in the fluid driver 40, valve assemblies 222, 242, and/or the hydraulic motor 3'). The control unit 266/drive unit 295 can then use the characteristic curves to precisely control the motor 41 and/or the valves in valve assemblies 222, 242.

Although the above embodiments were described with respect to an external gear pump design with spur gears having gear teeth, it should be understood that those skilled in the art will readily recognize that the concepts, functions, and features described above can be readily adapted to external gear pumps with other gear designs (helical gears, herringbone gears, or other gear teeth designs that can be adapted to drive fluid), internal gear pumps with various gear designs, to prime movers other than electric motors, e.g., hydraulic motors or other fluid-driven motors, internal-combustion, gas or other type of engines or other similar devices that can drive a fluid displacement member, and to fluid displacement members other than an external gear with gear teeth, e.g., internal gear with gear teeth, a hub (e.g. a disk, cylinder, other similar component) with projections (e.g. bumps, extensions, bulges, protrusions, other similar structures or combinations thereof), a hub (e.g. a disk, cylinder, or other similar component) with indents (e.g., cavities, depressions, voids or other similar structures), a gear body with lobes, or other similar structures that can displace fluid when driven. Accordingly, for brevity, detailed description of the various pump designs are omitted.

In addition, those skilled in the art will recognize that, depending on the type of pump, the meshing between the fluid displacement members can aid in the pumping of the fluid instead of or in addition to sealing a reverse flow path. For example, in certain internal-gear gerotor designs, the meshing between the two fluid drivers also aids in pumping the fluid, which is trapped between teeth of opposing gears. Further, while the above embodiments have fluid displacement members with an external gear design, those skilled in the art will recognize that, depending on the type of fluid displacement member, the meshing between the fluid displacement members is not limited to a side-face to side-face contact and can be between any surface of at least one projection (e.g. bump, extension, bulge, protrusion, other similar structure, or combinations thereof) on one fluid displacement member and any surface of at least one projection (e.g. bump, extension, bulge, protrusion, other similar structure, or combinations thereof) or indent (e.g., cavity, depression, void or other similar structure) on another fluid displacement member.

The fluid displacement members, e.g., gears in the above embodiments, can be made entirely of any one of a metallic material or a non-metallic material. Metallic material can include, but is not limited to, steel, stainless steel, anodized aluminum, aluminum, titanium, magnesium, brass, and their respective alloys. Non-metallic material can include, but is not limited to, ceramic, plastic, composite, carbon fiber, and nano-composite material. Metallic material can be used for a pump that requires robustness to endure high pressure, for example. However, for a pump to be used in a low pressure application, non-metallic material can be used. In some embodiments, the fluid displacement members can be made of a resilient material, e.g., rubber, elastomeric material, etc., to, for example, further enhance the sealing area.

Alternatively, the fluid displacement member, e.g., gears in the above embodiments, can be made of a combination of different materials. For example, the body can be made of aluminum and the portion that makes contact with another fluid displacement member, e.g., gear teeth in the above exemplary embodiments, can be made of steel for a pump that requires robustness to endure high pressure, a plastic for a pump for a low pressure application, a elastomeric material, or another appropriate material based on the type of application.

Pumps consistent with the above exemplary embodiments can pump a variety of fluids. For example, the pumps can be designed to pump hydraulic fluid, engine oil, crude oil, blood, liquid medicine (syrup), paints, inks, resins, adhesives, molten thermoplastics, bitumen, pitch, molasses, molten chocolate, water, acetone, benzene, methanol, or another fluid. As seen by the type of fluid that can be pumped, exemplary embodiments of the pump can be used in a variety of applications such as heavy and industrial machines, chemical industry, food industry, medical industry, commercial applications, residential applications, or another industry that uses pumps. Factors such as viscosity of the fluid, desired pressures and flow for the application, the design of the fluid displacement member, the size and power of the motors, physical space considerations, weight of the pump, or other factors that affect pump design will play a role in the pump design. It is contemplated that, depending on the type of application, pumps consistent with the embodiments discussed above can have operating ranges that fall with a general range of, e.g., 1 to 5000 rpm. Of course, this range is not limiting and other ranges are possible.

The pump operating speed can be determined by taking into account factors such as viscosity of the fluid, the prime mover capacity (e.g., capacity of electric motor, hydraulic motor or other fluid-driven motor, internal-combustion, gas or other type of engine or other similar device that can drive a fluid displacement member), fluid displacement member dimensions (e.g., dimensions of the gear, hub with projections, hub with indents, or other similar structures that can displace fluid when driven), desired flow rate, desired operating pressure, and pump bearing load. In exemplary embodiments, for example, applications directed to typical industrial hydraulic system applications, the operating speed of the pump can be, e.g., in a range of 300 rpm to 900 rpm. In addition, the operating range can also be selected depending on the intended purpose of the pump. For example, in the above hydraulic pump example, a pump designed to operate within a range of 1-300 rpm can be selected as a stand-by pump that provides supplemental flow as needed in the hydraulic system. A pump designed to operate in a range of 300-600 rpm can be selected for continuous operation in the hydraulic system, while a pump designed to operate in a range of 600-900 rpm can be selected for peak flow operation. Of course, a single, general pump can be designed to provide all three types of operation.

In addition, the dimensions of the fluid displacement members can vary depending on the application of the pump. For example, when gears are used as the fluid displacement members, the circular pitch of the gears can range from less than 1 mm (e.g., a nano-composite material of nylon) to a few meters wide in industrial applications. The thickness of the gears will depend on the desired pressures and flows for the application.

While the present invention has been disclosed with reference to certain embodiments, numerous modifications, alterations, and changes to the described embodiments are possible without departing from the sphere and scope of the present invention, as defined in the appended claims.

Accordingly, it is intended that the present invention not be limited to the described embodiments, but that it has the full scope defined by the language of the following claims, and equivalents thereof.

What is claimed is:

1. A hydraulic system comprising:

a hydraulic actuator that controls a load and having first and second ports;

a hydraulic pump to provide hydraulic fluid to the hydraulic actuator, the hydraulic pump including an interior volume, third and fourth ports in fluid communication with the interior volume, an electric motor disposed inside the interior volume, and a gear assembly comprising a first gear and a second gear disposed inside the interior volume, the gear assembly to be driven by the motor such that fluid is transferred from one of the third and fourth ports to the other of the third and fourth ports of the hydraulic pump; and a controller to control a speed, a torque, or both the speed and the torque of the electric motor to exclusively adjust a flow, a pressure, or both the flow and the pressure in the hydraulic system to a desired set point, wherein the electric motor is disposed inside the first gear of the gear assembly, wherein the controller includes one or more characteristic curves for the electric motor, including at least one curve to correlate a speed of the electric motor with a flow in the hydraulic system, and wherein the electric motor is a variable-speed motor.

2. The hydraulic system of claim 1, wherein the hydraulic actuator is a hydraulic cylinder.

3. The hydraulic system of claim 1, wherein the hydraulic actuator is a hydraulic motor.

4. The hydraulic system of claim 1, wherein the electric motor is a variable-torque motor.

5. The hydraulic system of claim 1, wherein the hydraulic system is a closed-loop system.

6. The hydraulic system of claim 1, further comprising:

at least one of a pressure transducer, a temperature transducer, and a flow transducer.

7. The hydraulic system of claim 1, wherein the controller includes a plurality of operational modes including at least one of a flow mode, a pressure mode, and a balanced mode.

8. The hydraulic system of claim 1, wherein the hydraulic pump is bi-directional.

9. A method for controlling a fluid flow in a hydraulic system, the hydraulic system including a hydraulic pump, the hydraulic pump to provide hydraulic fluid to a hydraulic actuator that controls a load, the hydraulic pump including an electric motor and a fluid displacement assembly having a first gear and a second gear, the first gear to be driven by the electric motor, with the fluid displacement assembly disposed in an interior volume of the pump and the electric motor disposed inside the first gear of the fluid displacement assembly, the method comprising:

initiating operation of the hydraulic pump;

changing a speed, a torque, or both the speed and the torque of the electric motor disposed inside the first gear to exclusively adjust a fluid flow, a pressure, or both the fluid flow and the pressure in the hydraulic system; and using one or more characteristic curves to control the electric motor, including at least one curve to correlate a speed of the electric motor with a flow in the hydraulic system, wherein the electric motor is a variable-speed motor.

10. The method of claim 9, wherein the operation of the hydraulic pump is initiated in a closed-loop system.

11. A fluid pumping system, the system comprising:

a pump to provide fluid to an actuator that is operated by the fluid, the pump including an interior volume, a prime mover disposed in the interior volume, and a fluid displacement assembly disposed in the interior volume, the fluid displacement assembly to be driven by the prime mover such that fluid is transferred from a first port of the pump to a second port of the pump; and a controller to control a speed, a torque, or both the speed and the torque of the prime mover so as to exclusively adjust a flow, a pressure, or both the flow and the pressure in the fluid pumping system to a desired set point, wherein the prime mover is disposed inside the fluid displacement assembly, wherein the controller includes one or more characteristic curves for the prime mover including at least one curve to correlate a speed of the prime mover with a flow in the fluid pumping system, and wherein the pump is a variable-speed pump.

12. The fluid pumping system of claim 11, wherein the fluid displacement assembly includes a first fluid displacement member that is driven by the prime mover and a second displacement member that is driven by the first fluid displacement member to perform the transfer from the first port of the pump to the second port of the pump, and wherein the prime mover is disposed inside the first fluid displacement member.

13. The fluid pumping system of claim 12, wherein the first fluid displacement member is a gear that includes an opening within a body of the gear for accepting the prime mover.

14. The fluid pumping system of claim 11, wherein the pump is a variable-torque pump.

15. The fluid pumping system of claim 11, wherein the fluid pumping system is a closed-loop system.

* * * * *